US006371240B1

(12) United States Patent
Hayes et al.

(10) Patent No.: US 6,371,240 B1
(45) Date of Patent: Apr. 16, 2002

(54) ANECHOIC CHAMBER

(75) Inventors: Robert W. Hayes; John Phillips, both of Austin, TX (US)

(73) Assignee: Austin Acoustic Systems, Inc., Austin, TX (US)

( * ) Notice: Subject to any disclaimer, the term of this patent is extended or adjusted under 35 U.S.C. 154(b) by 0 days.

(21) Appl. No.: 09/577,516

(22) Filed: May 23, 2000

Related U.S. Application Data

(60) Provisional application No. 60/190,484, filed on Mar. 18, 2000.

(51) Int. Cl.[7] ..... E04B 1/99; E04B 1/82

(52) U.S. Cl. ..... 181/30; 181/295; 181/292; 181/296

(58) Field of Search ..... 181/30, 123, 210, 181/286, 287, 290, 292, 294, 285, 295, 296

(56) References Cited

U.S. PATENT DOCUMENTS

| | | | | | |
|---|---|---|---|---|---|
| 3,812,931 | A | * | 5/1974 | Hauskins, Jr. | 181/33 E |
| 3,819,007 | A | * | 6/1974 | Wirt et al. | 181/33 G |
| 3,857,459 | A | * | 12/1974 | Adams et al. | 181/33 GD |
| 5,317,113 | A | * | 5/1994 | Duda | 181/285 |
| 5,504,281 | A | * | 4/1996 | Whitney et al. | 181/286 |
| 5,594,218 | A | * | 1/1997 | Diaz et al. | 181/295 |
| 5,780,785 | A | * | 7/1998 | Eckel | 181/295 |
| 5,834,711 | A | * | 11/1998 | Haines | 181/290 |
| 6,082,490 | A | * | 7/2000 | Rowland | 181/295 |

FOREIGN PATENT DOCUMENTS

| | | | | |
|---|---|---|---|---|
| FR | 2612217 | * | 9/1988 | 181/210 |
| FR | 2612225 | * | 9/1988 | 181/210 |
| GB | 2312086 | * | 10/1997 | E04B/1/82 |
| JP | 3-161603 | * | 7/1991 | 181/210 |
| JP | 4-79300 | * | 3/1992 | 361/818 |

* cited by examiner

*Primary Examiner*—Jeffrey Donels
*Assistant Examiner*—Edgardo San Martin
(74) *Attorney, Agent, or Firm*—Milde, Hoffberg & Macklin, LLP

(57) ABSTRACT

The modular anechoic panel system provides modular anechoic panel for construction of anechoic chambers particularly advantageous for use in sound testing and measurement. The modular anechoic panel incorporates into a single structural member the elements of structural support, transmission loss features, and the wedge base and air space elements of an anechoic wedge thus providing enhanced protection to elements of the anechoic wedge. The modular anechoic panel provides a durable structural member and, as assembled, form a structural shell of an anechoic chamber having a reduced footprint. Additionally, the modular anechoic panel provides a compression clip mounting system for conveniently mounting and replacing wedge tips, thus allowing for use of standard wedge tip materials and easy assembly, repair and replacement of damaged wedge tips. The wedge is preferably formed of perforate sheet metal having a void ratio of greater than 52%, and more preferably 63%, and is packed with sound absorptive material, such as fiberglass.

33 Claims, 26 Drawing Sheets

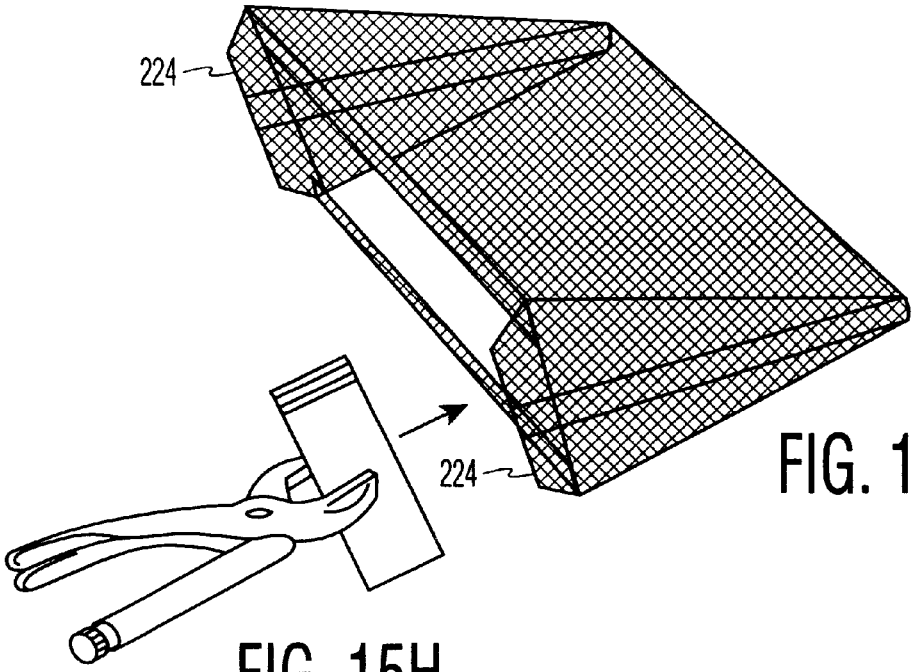
FIG. 15G
FIG. 15H
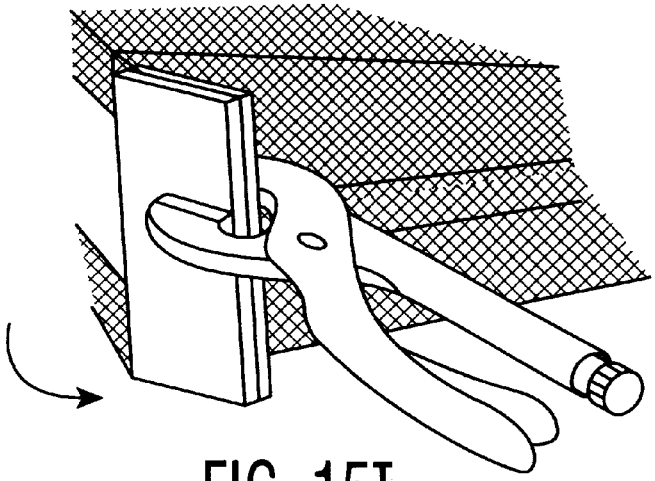
FIG. 15I
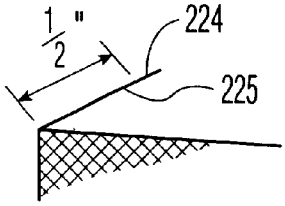
FIG. 15J

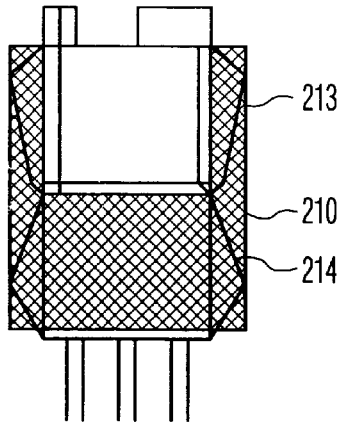
FIG. 17A1
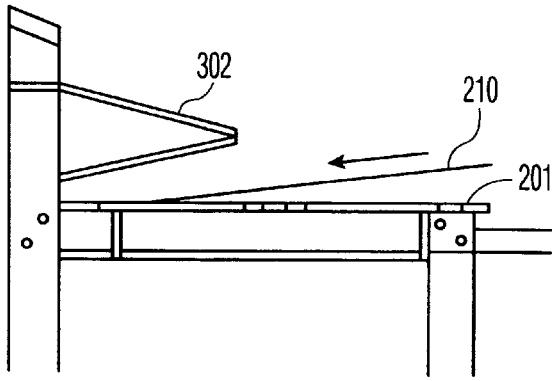
FIG. 17A2
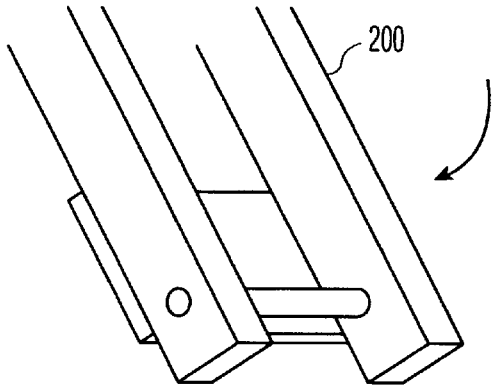
FIG. 17B1
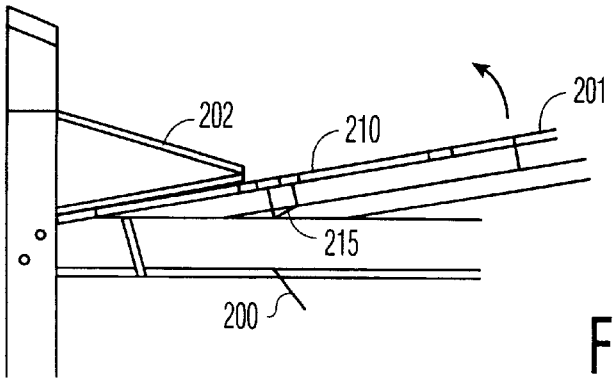
FIG. 17B2

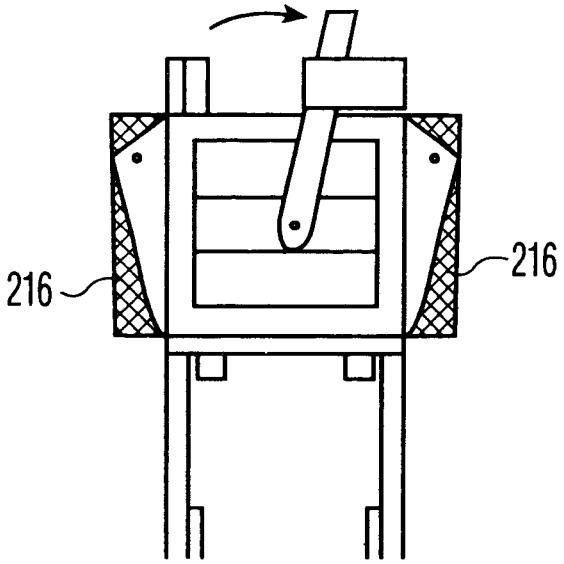
FIG. 17D1
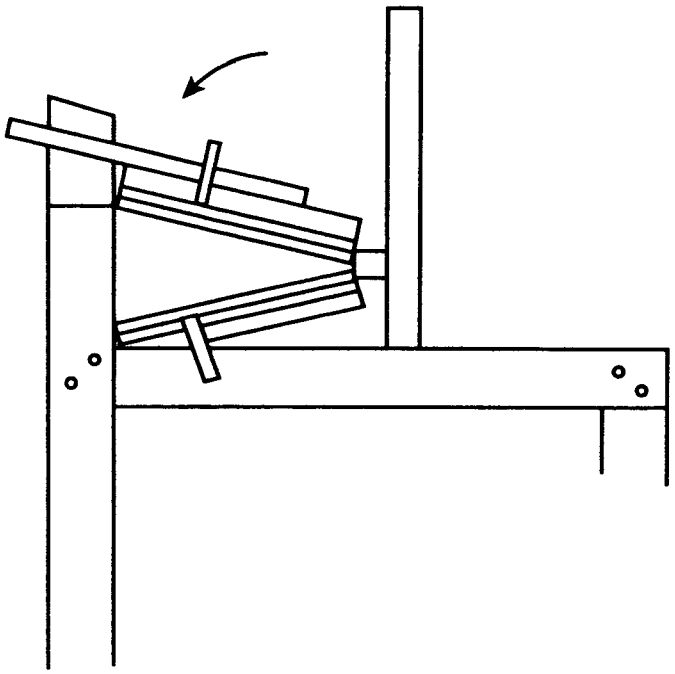
FIG. 17D2

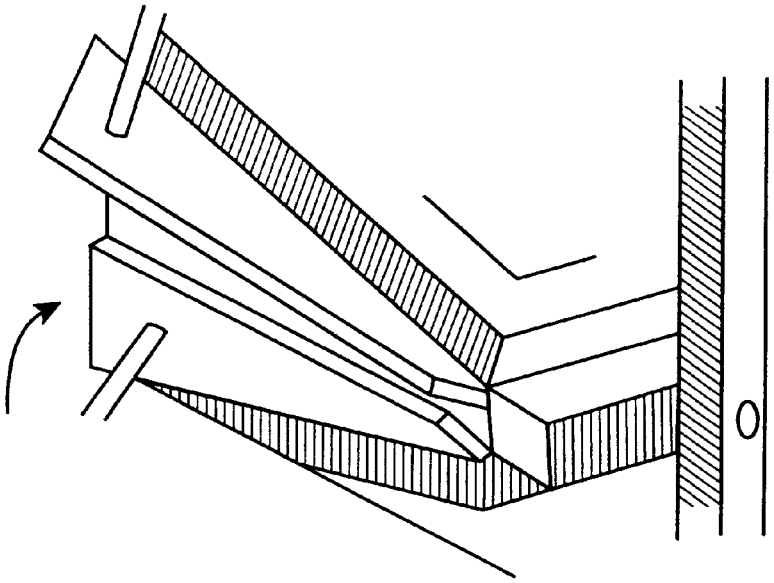
FIG. 17G1
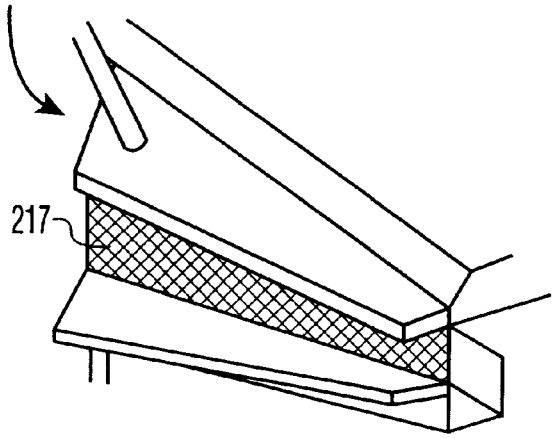
FIG. 17G2
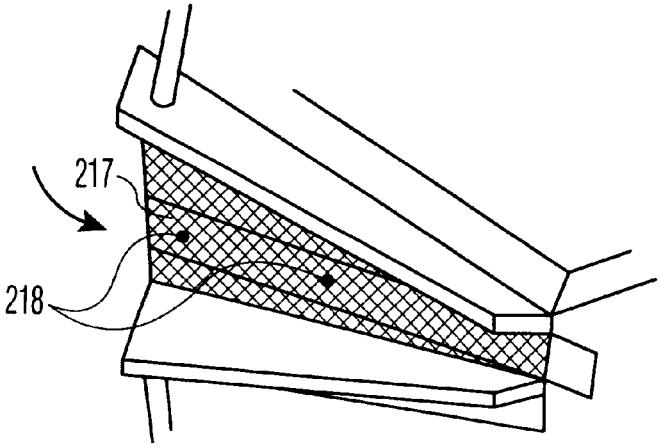
FIG. 17G3

ANECHOIC CHAMBER

RELATED APPLICATIONS

This application claims benefit of Prov. No. 60/190,484 filed Mar. 18, 2000.

The present application is related to U.S. patent application Ser. No. 08/893,008, filed Jul. 15, 1997.

TECHNICAL FIELD

This present invention relates to the field of anechoic chambers, and in particular to a modular anechoic panel system and method.

BACKGROUND OF THE INVENTION

The character and quality of noise emitted from manufactured products has become increasingly important to the function and marketability of such manufactured products. Product manufacturers, governments, and standard setting organizations often require consumer and industrial products and equipment to comply with increasingly stringent sound emission specification. Accordingly, a large number of consumer products and industrial equipment must now undergo sound emission testing.

Anechoic chambers, constructed using acoustical anechoic wedges are frequently employed in such sound emissions tests. According to previous techniques, an anechoic chamber consists of a shell constructed of material to provide structural stability and predictable transmission loss characteristics from the exterior of the anechoic chamber to the interior of the anechoic chamber and an array of sound-absorbing anechoic wedge devices ("anechoic wedges") lining the shell's interior surfaces to eliminate interior reflected sound. Materials used in the construction of shells for anechoic chambers have included various materials, such as masonry, wood, and metal. Shell designs have included permanent shell structures, as well as semi-permanent shells constructed of modular interlocking structural panels. Anechoic chambers with anechoic wedges or other linings on all interior surfaces are typically referred to as "full" anechoic chambers while chambers having linings on only the walls and ceiling are referred to as "hemi" anechoic chambers. Anechoic chambers, both hemi and full, are used in the testing and or measurement of sound characteristics emitted by a specimen being tested or calibrated.

An anechoic chamber is a room that is used for precise acoustical measurements. Therefore, the room must be designed so that acoustically free field conditions exist. For practical measurements, the room also must be free of extraneous noise interferences. Anechoic chambers are widely used in the development of quieter products, including automotive and aircraft products and other products for use in transportation, communications, computers, security, and medical research.

An acoustical free field exists in a homogeneous, isotropic medium that is free of reflecting boundaries. In an ideal free field environment, the inverse square law would function perfectly, so that the sound pressure level generated by a spherically radiating sound source decreases approximately six decibels (6 dB) for each doubling of the distance from the source. A room or enclosure designed and constructed to provide such an environment is called an anechoic chamber.

Also usually an anechoic chamber must provide an environment with controlled sound pressure ($L_p$) free from excessive variations in temperature, pressure and humidity. Outdoors, local variations in these conditions, as well as wind and reflections from the ground, can significantly and unpredictably disturb the uniform radiation of sound waves. This means that a true acoustical free field is only likely to be encountered inside an anechoic chamber. For an ideal free field to exist with perfect inverse square law characteristics, the boundaries must have a sound absorption coefficient of unity at all angles of incidence.

Anechoic chambers are characterized by anechoic elements that are attached to the walls, ceiling and floor of the chamber. If the anechoic elements are attached to the walls and ceiling but not the floor of the chamber, the chamber is termed a hemi-anechoic chamber. Such chambers also are used for acoustical measurements. The anechoic elements may be attached so that they are essentially in contact with or spaced from the supporting walls, ceiling and floor, depending on what is considered to be the optimum design for the chamber based on its intended use.

An anechoic element is commonly defined as one that should have less than a 0.99 normal incidence sound absorption coefficient through the frequency range of interest. In such case, the lowest frequency in a continuously decreasing frequency sweep at which the sound absorption coefficient is 0.99 at normal incidence is defined as the cut-off frequency. Thus, in an anechoic chamber, 99% of the sound at or above the cut-off frequency is absorbed. For less than ideal conditions, different absorption coefficients may be established to define a cut-off frequency. Heretofore anechoic elements for anechoic chambers have commonly been designed in the shape of a wedge.

As already noted, a characteristic of a true free field is that the sound behaves in accordance with the inverse square law. In the manufacture of anechoic elements, those elements are tested in impedance tubes as a means for qualifying them for use in chambers simulating free field conditions. A fully anechoic chamber can also be defined as one whose deviations fall within a maximum of about 1–1.15 dB from the inverse square law characteristics, depending on frequency. According to currently accepted standards, semi-anechoic rooms or chambers, i.e., those with anechioic walls and ceilings but with acoustically reflective floors, e.g., floors made of concrete, asphalt, steel, or other metals or materials, can deviate from the inverse square law by a maximum of about 3 dB depending on frequency.

Because of the very high degree of sound absorption required in an anechoic chamber, conventional anechoic elements typically comprise sound absorptive material covered or contained by a cage or cover that is made of a wire cloth (mesh) or a perforated sheet metal. For many years anechoic elements typically embodied a wire mesh cage that typically was characterized by a 90–95% open area to allow maximum exposure of sound absorbing material to the sound waves.

A disadvantage with anechoic construction elements as explained above is that in highly industrial environments the wire mesh structure may not provide sufficient physical protection for the elements. The sound absorbing material can therefore become easily disfigured by unintentional impact that is quite foreseeable in a heavily industrial environment.

Another disadvantage of the conventional anechoic elements is potential medical hazards. The sound absorptive materials such as fiberglass, rockwool or foams can be highly erosive. Over a period of use such materials could erode into particulate matter floating in the air which could be inhaled into lungs.

A further disadvantage of the conventional anechoic elements and their wire mesh coverings is that in highly industrial applications, oil spills and dirt may rapidly accumulate on the sound absorbing materials. This may impede sound absorption performance of the material and additionally may impose a fire hazard. Cleaning the sound absorptive material is difficult and not efficient.

More recently, the wire mesh covering has been replaced by a perforated sheet metal, with the an open area provided by the perforations falling within a relatively wide range: usually the open area falls within the range of about 23% to about 52% of the entire area of the sheet metal covering.

The earliest practical design for sound absorbing units of the type used in making anechoic chambers was a wedge-shaped unit fabricated from or comprising fibrous glass. That geometry of anechoic wedges has been employed as the basis for anechoic chamber design and construction in the past. Examples of prior art anechoic elements and chambers made using such elements are provided by U.S. Pat. Nos. 2,980,198, 3,421,273, and 5,317,113, and the technical publications by L. L. Beranek et al, "The Designs And Construction of Anechoic Sound Chambers", J. Acous. Soc. of America, Vol. 18, No. 1, pp.140–150, July 1946; and B. G. Watters, "Design of Wedges For Anechoic Chambers", Noise Control, pp. 368–373, November 1958.

The cross-section of the conventional wedge shaped anechoic element consists of a square or rectangular base, with two opposite side surfaces of the element tapering to a line junction with one another. The length of the wedge unit. i.e., the distance measured from the line junction to the base, varies according to the low frequency cutoff desired in the chamber. The lower the low frequency cut-off, the longer the wedge unit or overall depth of treatment required to create an anechoic environment. Typically, a quarter wavelength of the desired low frequency cutoff approximates the overall depth of treatment that is required to create an anechoic environment in a test chamber. The depth of treatment is determined by the geometry of the anechoic wedge and the wall of the sound attenuating structure. Various combinations of wedge taper, size, and air gap (if any) between the anechoic element and the supporting wall structure may be required in order to achieve the proper depth of treatment for various low frequency cut-offs.

In addition to the shape of the anechoic wedge unit, both the flow resistance of that wedge unit and the sound absorbing material of which the wedge is constructed are critical to the performance of the wedge-shaped anechoic elements and the chamber that employs same.

There have been a number of changes in the design and construction of units used in the construction of anechoic wedge chambers. These changes have included changes in the sound absorbing materials, along with different protective coverings and support systems. Wedges fabricated from polyether or polyester open cell foams, e.g., polyurethane foams, or melamine, have been used for the wedge material. These have the advantage of light weight.

To increase sound absorbency in anechoic chambers, conventional industry practice has been to mount anechoic wedges having a wedge tip, wedge base, and air space elements in an array of alternating groupings of horizontal and vertical wedges over the entire interior surface of the anechoic chamber. Industry standards dictate that anechoic wedges should achieve greater than 90% sound absorption at the lowest frequency to be measured (the "cut-off frequency"). The shape, dimensions and composition of an anechoic wedge are governed by mathematical equations well known in the art. The size and dimensions of an anechoic chamber depend upon the size of the specimen to be tested and upon the frequency range to be measured. For example, small computer devices and equipment may only require an anechoic chamber the size of a medium-sized room, whereas large construction equipment and jet airplanes may require a chamber as large as an airplane hanger.

The anechoic chamber preferably should be capable of testing specimens at a broad spectrum of cutoff frequencies. The cut-off frequency similarly governs the chamber's dimensions. To achieve accurate low-frequency measurements, the measuring equipment should be located a sufficient distance from the equipment being tested and from the chamber's wall. ANSI standards specify that a measuring microphone be located no closer than one meter to the specimen and no closer than ¼ of the wavelength of the cut-off frequency to the tip of the anechoic wedge. Similarly, the necessary depth of an anechoic wedge is inversely proportional to the specified cutoff frequency. Like the anechoic chamber itself, is the specified cut-off frequency decreases, the wedge depth of a standard anechoic wedge must increase in proportion to the cut-off frequency's wave length in order to obtain sufficient low frequency sound absorption. Specifically, the wedge depth may be no less than ¼ of the wavelength of the cut-off frequency. Accordingly, as the cut-off frequency to be measured decreases, the necessary size and dimensions of the anechoic wedges and the anechoic chamber increase. As the specified cut-off frequency decreases, the wavelength of the cut-off frequency and the wedge depth and the size of the anechoic chamber increase proportionately. The increase in wedge depth can often be significant. For example, the industry standard cut-off frequency of 125 hertz would have a wavelength of 2.76 meters and require a wedge depth of 0.7 meters, whereas a lower cut-off frequency of 50 hertz would have a cut-off frequency of approximately 6.9 meters and require a wedge depth of approximately 1.72 meters.

This increase in required wedge depth has presented unique problems for the design of anechoic chambers. Increased wedge depth results in an exponential increase in both the volume and cost of sound absorptive material needed to construct the anechoic wedges.

Similarly, the increased size of the needed anechoic wedge also causes a corresponding increase in the necessary footprint for the anechoic chamber. Unfortunately, due to the low-rigidity of most sound absorptive materials, standard anechoic wedges exceeding a certain wedge depth may bend or break from their mounts under their own weight. At larger sizes, standard anechoic wedges also become extremely cumbersome, difficult to manipulate, and difficult to mount using conventional mounting systems Also, given the increasing variety of products, industrial machinery, and equipment now being tested, anechoic chambers used to conduct such sound tests are exposed to more rigorous environments. Exposure to such rigorous environments frequently results in damage to and requires the replacement of the delicate sound-absorbing anechoic wedge tips used in such anechoic chambers.

Several techniques have been employed to strengthen and protect the anechoic wedges. One previous technique has been to enshroud the wedge tip and wedge base elements of the anechoic wedge with a wire cloth framework to provide structural support. Unfortunately, the overall size or cost of the wedge is not significantly affected and the direct introduction of such reflective material into the anechoic chamber may result in sound reflections which reduce the accuracy of the measurements. Another attempt at addressing this problem is demonstrated by the sound absorbing unit described in U.S. Pat. No. 5,317,113 in which perforated metal is used to shape, contain and protect the wedge material. Sound absorption may be sacrificed compared with a standard anechoic wedge. According to another previous technique, the wedge tip and wedge base are joined into an integral unit by an exterior housing. To form the air space element of the anechoic wedge, the housing containing the anechoic wedge base and tip is suspended or offset mounted approximately 3" to 4" inches away from the anechoic chamber's inner surface to create the air space important to the function of the anechoic wedge. Several methods are known in the art for mounting the wedge elements in this fashion, including the use of furring strips to offset mount housings containing a configuration of wedge base and wedge tips. Unfortunately, the use of frameworks and offset mounting of the anechoic wedges has turned out to be both costly and maintenance intensive. Typically, damaged wedges cannot be replaced without significant effort and expenses. Often, to replace a single wedge tip, an entire series of wedges must be removed from their mountings.

It is well known that in an anechoic chamber having wedges, the surface of the wedges need not be completely sound absorptive, and, indeed, if such complete absorption was possible, the wedge configuration itself would be unnecessary. Thus, the purpose of the wedges is to partially absorb and partially reflect the acoustic waves. Due to the steep wedge angles, reflected acoustic waves are trapped between adjacent wedges by a process of total internal reflection, such that any portion which is retro-reflected from the recess is highly attenuated. See. Warnaka, U.S. Pat. No. 4,477,505 (see FIG. 2), Pelonis, U.S. Pat. No. 5,141,073 (see FIG. 4), and U.S. Pat. No. 5,317,113, each of which is expressly incorporated herein by reference.

Thus, as long as the surface is only partially acoustically reflective, the elongated wedge will tend to absorb the sonic energy. A number of advantages are apparent from the use of a perforated sheet metal cover over the acoustically absorptive material in the wedge. These covered structures tend to have improved impact resistance, and indeed the acoustically absorptive material placed inside need not be self-supporting. The cover sheet, serves to retain the acoustically absorptive contents, and thus may prevent mineral wool or fiberglass fibers inside from becoming airborne. The perforated surface may also be cleaned, repainted or the like, since the acoustic properties of the surface are non-critical, likewise, under unusual circumstances, a further acoustically absorptive treatment may be applied for enhanced performance. The perforated steel also facilitates fire retardancy, even if the contents are somewhat flammable or contaminated with oil.

Thus, a need has arisen for an efficient anechoic wedge system for anechoic chambers that would employ traditional wedge materials while minimizing the overall size necessary for the wedge and room and providing sufficient protection to the anechoic wedge elements.

Similarly, it would be advantageous to provide a mounting system or method which would protect the anechoic wedge from damage and would permit ease of mounting, repairing and replacing of the anechoic wedges.

SUMMARY AND OBJECTS OF THE INVENTION

The modular anechioic panel system of the illustrative embodiment advantageously provides structural modular anechoic panels for the assembly of wall, roof and/or floor components of an anechoic chamber. Each modular anechoic panel is structurally self supporting and contains the acoustical wedge base and air space elements of an anechoic wedge. In the illustrative embodiment, an acoustically transparent interior shelf and a structural face plate retain the wedge base, air space, and transmission loss material in position within the modular anechoic panel's structural steel frame. H-joints permit numerous modular anechoic panels to connect to one another to form a shell such that each panel's face plate becomes a portion of the interior surface of the assembled anechoic chamber. Additionally, a wedge tip compression clip system allows selective mounting of the wedge tips flush to the surface of the face plates.

It has been found that the performance of the anechoic wedges may be improved by providing a configuration of the apertures of a perforated steel sheet facing having a high void ratio, without impairing the substantial mechanical performance of the wedges. In particular, while it is known that the acoustic reflectivity of the wedge surface is not a per se acoustic advantage, the structural integrity of the wedges and the manufacturability thereof is enhanced by providing a void ratio of less than 50%. Thus, traditional practical considerations compelled an acoustically inferior solution.

The present inventor has found, however, that the void ratio of the perforated sheet metal facing sheet may be increased to about 63% while maintaining structural integrity, other advantages of a perforated sheet covering, and manufacturability. Thus, the substantial acoustic reflectivity mandated by the design of Duda, U.S. Pat. No. 5,317,113, is overcome.

In fact, by providing an open mesh arrangement of the cover, acoustic reflectivity is held to low levels, over a broad range of frequencies, thus improving the performance of the wedges. Improvements in acoustic absorptivity, in turn, leads to a reduced need for wedge volume. Thus, for the sale interior volume, smaller external dimensions are required for an anechoic chamber. Further, reduced sheet metal weight leads to educed overall weight, leading to reduced transportation costs and raw material costs. Further, since the wedges must be mounted within the chamber, the mounting hardware is subject to less stress. Maintenance of the chamber, which might involve removal of the wedges, is also facilitated.

It is technical advantage that the incorporation of the anechoic wedge elements with each modular anechoic panel forming the anechoic chamber's structural shell permits the absorption of sound in an anechoic chamber having a reduced overall room footprint.

In addition, the illustrative embodiment provides a modular design that provides a level of protection to many elements of the acoustic wedge, and is cast efficient to manufacture, assemble, and maintain relative to previous techniques. Moreover, the compression clip system of the illustrative embodiment provides for ease of installation, maintenance, and repair of wedge tips, which are susceptible to exposure and damage. Should a wedge tip become unacceptably soiled or otherwise damaged it can be removed and replaced by hand and at far lessor cost than conventional means.

It is therefore an object of the invention to provide amodular wedge for an anechoic panel, comprising a unitary perforated metal sheet having greater than about 52% void area, formed in a wedge shape having a depth, and having therein an acoustically absorptive material, having an acoustic absorption of at least 90% at a cutoff frequency defined by a corresponding wavelength 4 times the depth. The sheet preferably has less than 80% void area, and more preferably a void area of about 63%.

It is a further object of the invention to provide a system and method for manufacture of anechoic chamber wedges which formed each wedge from a single sheet of perforated metal, bent to shape, and held in conformation by a set of rivets, said rivets passing through regular perforations in the perforated metal sheet.

The wedge is preferably packed with an acoustically absorptive material, such as acoustically absorptive fiberglass, and may be packed in layers to provide further control over absorption characteristics.

It is a further object of the invention to provide a substantially enclosed sound absorbing unit for an anechoic chamber, comprising a substantially flat panel member having a layer of sound absorptive material, and an anechoic wedge member disposed adjacent to said flat panel member, said anechoic wedge member configured having a base and four protruding walls, at least two of which are convergent, formed from a substantially sound transparent sheet having perforations formed therein, said perforations encompassing at least about 52% of the total area of the sheet.

BRIEF DESCRIPTION OF THE DRAWINGS

FIGS. 15C, 15D, 15G, and 15I show, respectively, perspective transformative stages of a bending operation to form a base of a wedge;

FIG. 15J shows a cross section view of FIG. 15G;

FIG. 15H shows a lip bending tool;

FIGS. 17A1, 17A2, 17B1, 17B2, 17C, 17D1, 17D2, 17E1, 17E2, 17F, 17G1, 17G2, 17G3, and 17H show perspective views respectively of a series of transformative steps for converting a planar sheet of perforated metal into a wedge shell;

DETAILED DESCRIPTION OF THE PREFERRED EMBODIMENTS

An illustrative embodiment of the present invention and its advantages are better understood by reference to FIGS. 1 through 19.

Figure 1:
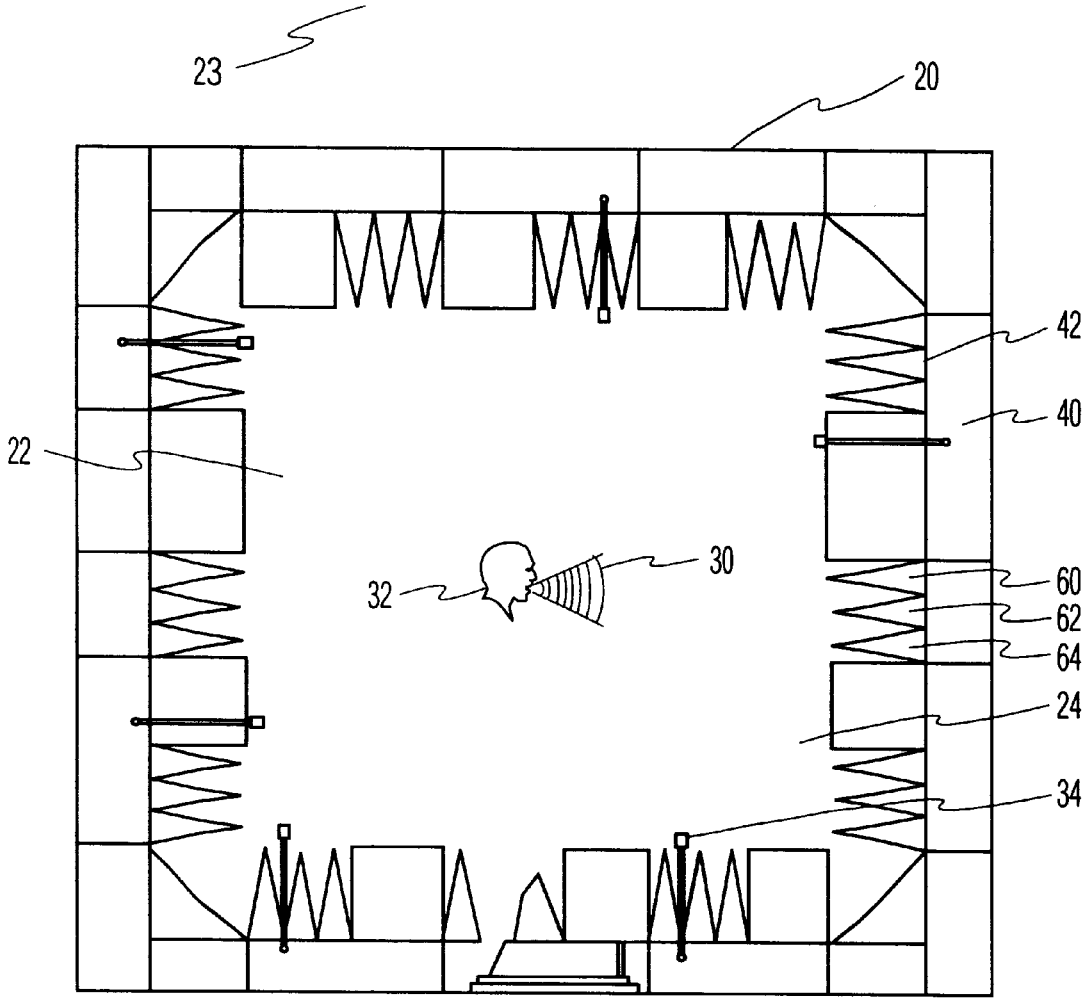
FIG. 1 is an overhead plan view of an illustrative embodiment of an anechioic chamber employing the modular anechoic panel system.

FIG. 1 shows an anechoic chamber 20 constructed from an illustrative embodiment of modular anechoic panels 40 utilizing the modular anechoic panel system. The anechoic chamber 20 absorbs sound emissions 30 to create an essentially echo-free room 22 in which acoustically free field conditions exist. These echo-free conditions within the anechoic chamber 20 allow for precise acoustical measurements to be taken of the sound-pressure levels and frequency emissions from specimen 32, such as equipment and products.

During product testing, a test specimen 32 may be positioned in the anechoic chamber 20 along with microphones 34 and other sound measurement instruments. To increase the accuracy of sound measurements, the testing instruments preferably measure only the direct sound emissions 30 of the test specimen 32. Thus, the anechoic chamber 20 preferably reduces all reflected sound within the room 22 and filters extraneous noise from sources emanating from the exterior 23 of the anechoic chamber 20. By reducing reflected and extraneous sound, the anechoic chamber 20 enhances the accuracy of the measurement and analysis of the sound emissions 30 actually generated by the test specimen 32.

Figure 2:
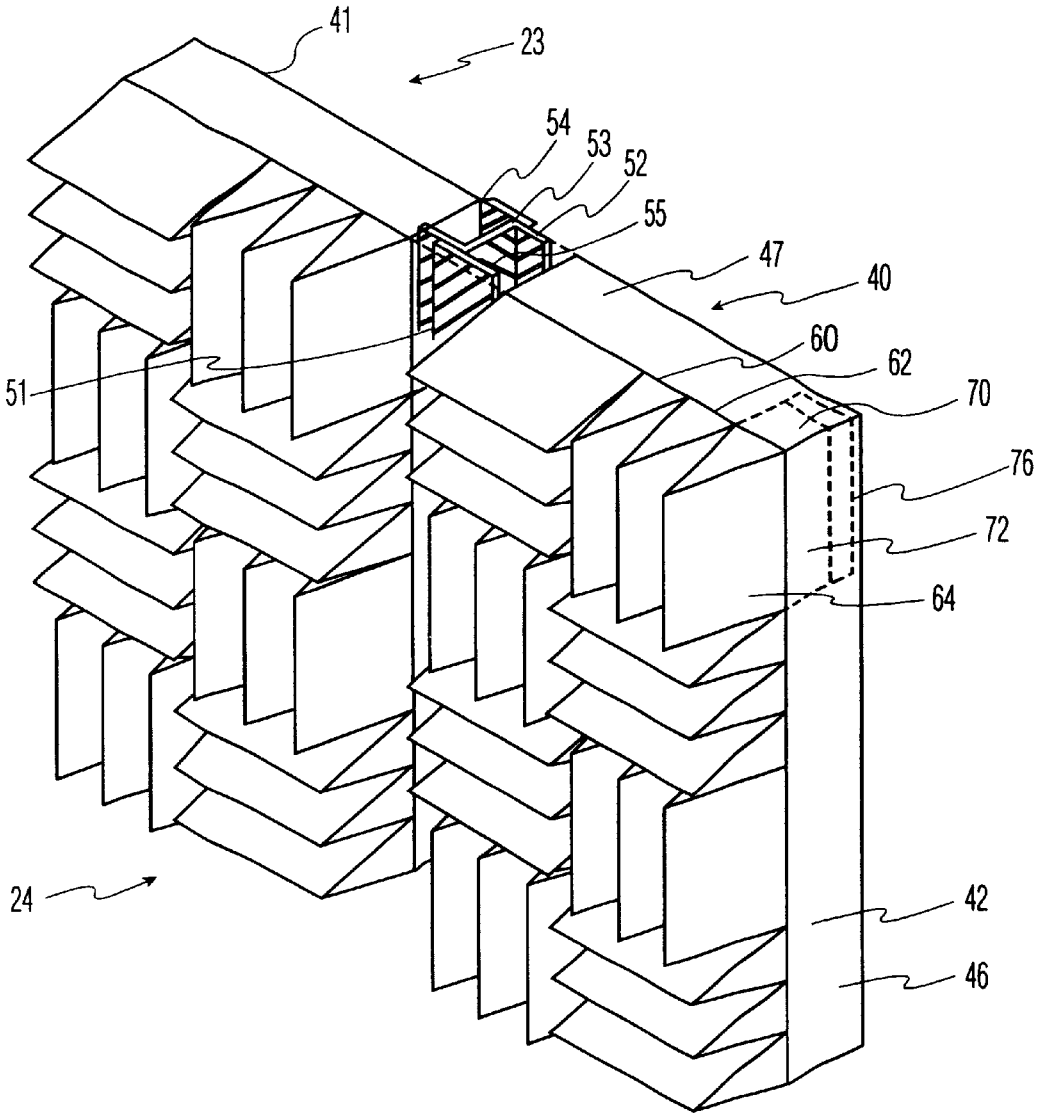
FIG. 2 is an isometric view showing the method of joining a pair of modular anechioic panels and further highlighting the positioning of the anechoic wedge elements.

Preferably, as shown in greater detail in FIG. 2, an H-joint 51 interconnects successive pairs of modular anechoic panels 40 and 41 to form anechoic chamber 20. To reduce sound leak-through. Z-shaped member 52 eliminates any direct sound path between the exterior 23 and the interior 24 of the anechoic chamber 20. To form each H-joint 51, spot welds 53 attach longitudinal beams 54 and 55 to Z-shaped member 52. Sound leak-through may be further reduced through other well-known construction techniques such as the application of caulking to any mating surfaces.

In the modular anechoic panel system of the illustrative embodiment successive pairs of modular anechoic panels 40 and 41 join to form wall, roof, and floor sections and anechoic chamber 20. Joinder of floor, roof, and/or wall sections may be accomplished through the application of techniques well known in the art to a person of ordinary skill. Accordingly, anechoic chambers 20 of various sizes may be assembled using selected quantities of modular anechoic panels 40.

In the illustrative embodiment, a series of wedge tips 60, 62, and 64 mount to the interior surface 42 of each modular anechoic panel 40. Compression clips 140 and 142 (shown in FIGS. 8 and 9) selectively retain wedge tips 60, 62, and 64 flush to interior surface 42 of modular anechoic panel 40.

Figure 3:
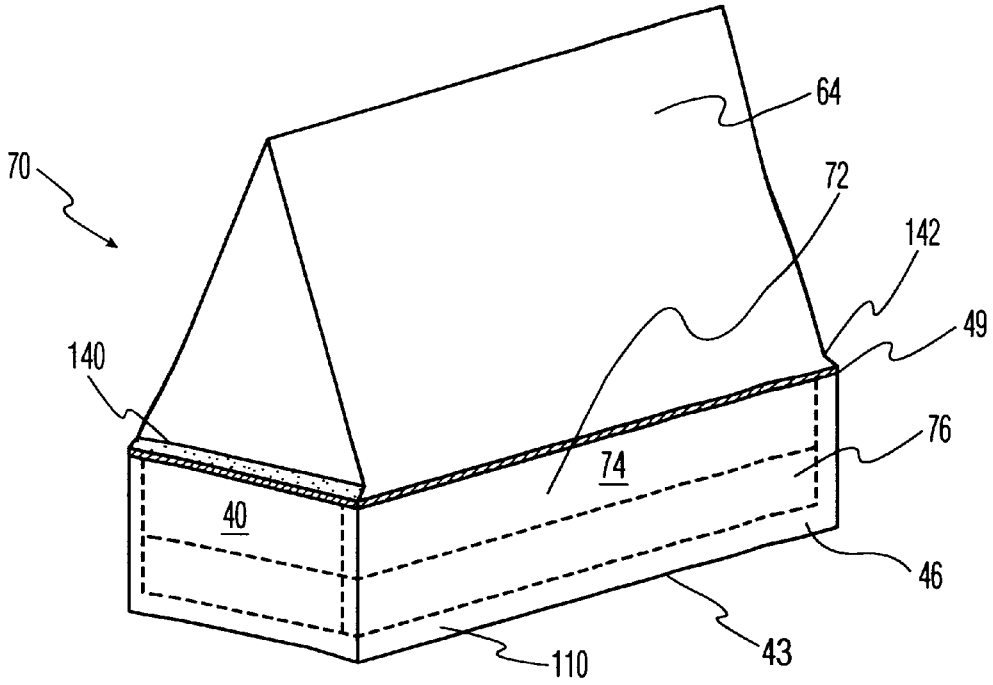
FIG. 3 depicts all isometric view of the anechoic wedge elements contained in a portion of the illustrative embodiment.

As further shown in FIG. 3, wedge tip 64 and the internal components of modular anechoic panel 40 constitute an anechoic wedge 70. According to previous techniques, anechoic wedges are sound-absorptive acoustical devices for absorbing incident sound, thereby eliminating sound reflections. Anechoic wedge 70 creates a frequency specific, essentially sound reverberation free environment within anechoic chamber 20.

Anechoic wedge 70 is composed of three critical elements necessary to achieve effective sound absorption: wedge tip 64 protruding perpendicular from the modular anechoic panel 40 toward the interior 24 of the anechoic chamber 20, wedge base 72 and airspace 76 contained within modular anechoic panel 40. According to previous techniques, wedge tips 60, 62, and 64 are constructed of a sound-absorptive material and have angular wedge-shaped bodies. The angular shape of wedge tip 64 provides the high surface area necessary for absorbing sound emissions 30. Preferred sound absorptive materials used in the past to construct wedge tips 60, 62, and 64 include various low-rigidity materials such as fiberglass and foam. (While melamine is the foam material of choice, it is extremely costly on a volume basis). Wedge base 72 similarly may be constructed of any sound-absorptive material that has "blow through" (i.e., that allows sound to pass through it) and has a density higher than the material comprising the wedge tip 64. Preferably, wedge base 72 is constructed of multiple layers of type-703 fiberglass 74. The wedge tip 64, wedge base 72 and air space 76 configuration provides a density change over the length of the anechoic wedge 70 which assists in eliminating sound reflections. Accordingly, the elements of wedge base 72 and air space 76 are contained within modular anechoic panel 40, as compared with previous techniques which disposed the wedge base and the air space elements within the interior surface of the anechoic chamber's shell, resulting in difficulty in assembly and repair.

Figure 4:
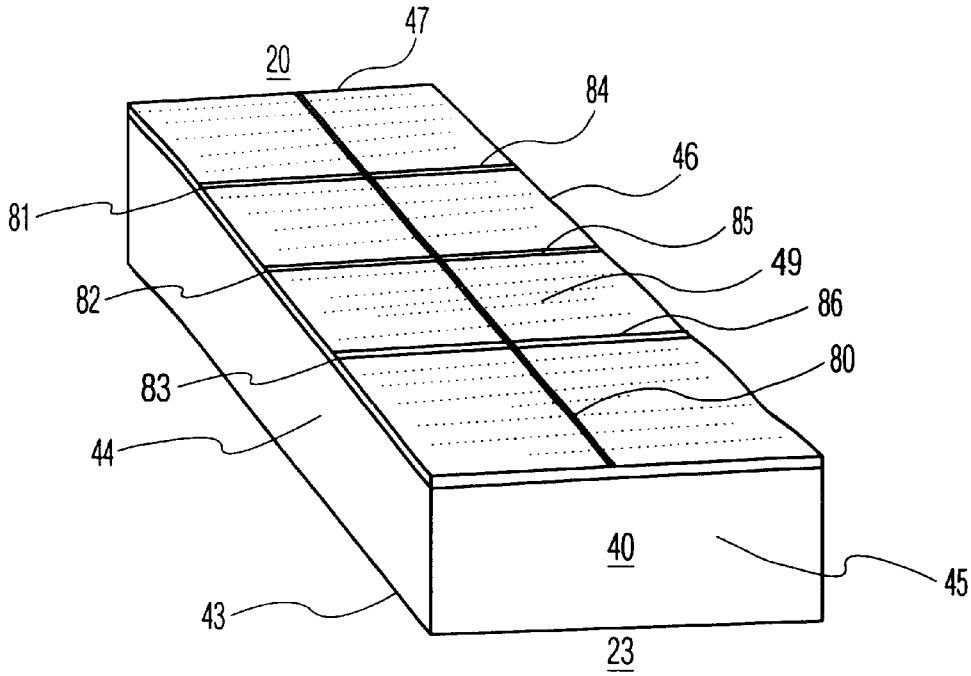
FIG. 4 is an isometric view of an illustrative embodiment of an assembled modular anechoic panel.
Figure 5:
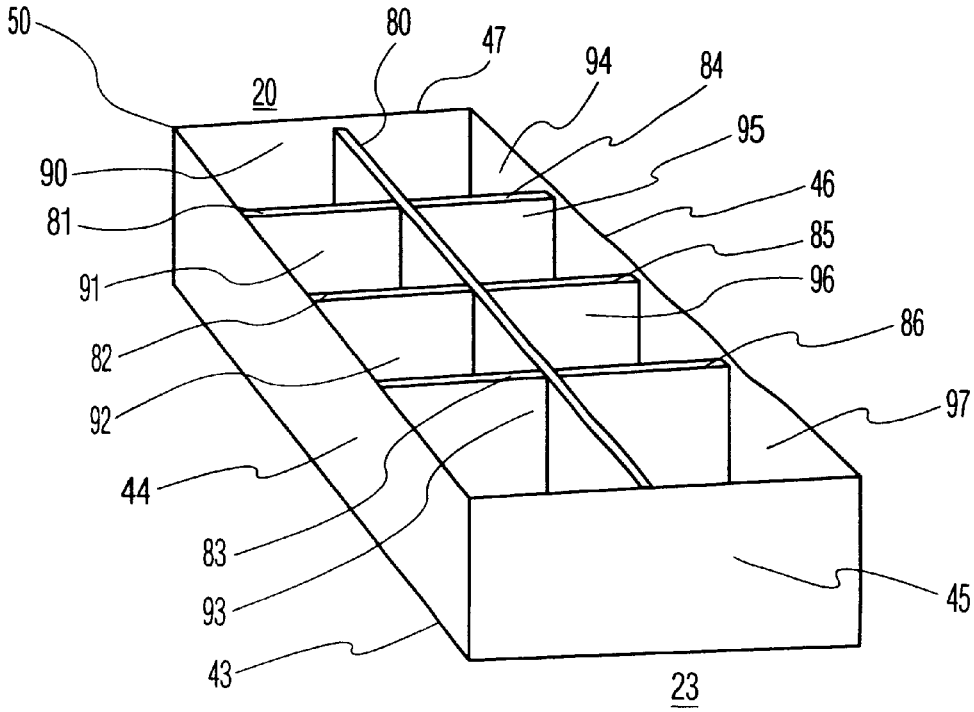
FIGS. 5 through 7 are isometric cut-away views revealing the internal construction and partitioning into zones and cells of an illustrative embodiment of a modular anechoic panel.

FIGS. 4 through 7 detail the internal components and construction of an illustrative embodiment of the modular anechoic panel 40. As shown in FIG. 4, modular anechoic panel 40 of the illustrative embodiment includes back wall 43, side walls 44, 45, 46, and 47 and face plate 49. Back wall 43 and side walls 44, 45, 46, and 47 preferably are formed from material having suitable structural integrity to provide rigidity, strength and durability, such as 16-gauge steel permanently joined. However, back wall 43, and side walls 44, 45, 46 and 47 may alternatively be constructed of any rigid structural material. Face plate 49 is an acoustically transparent sheet having structural integrity, preferably 22-gauge perforated steel.

Perforations of face plate 49 permit sound emissions 30 from a specimen 32 within anechoic chamber 20 to pass substantially unimpeded into the modular anechoic panel 40. Conventional mounting methods such as pop rivets mount face plate 49 to side walls 43, 44, 45, and 46 and fix the position of the internal components of modular anechoic panel 40.

A method of forming modular anechioic panel 40 is shown in more detail in FIGS. 5 through 8. Center partition 80 and fiberboard Lateral partitions 81, 82, 83, 84, 85, and 86 partition the housing 50 (formed by the back wall 43 and side walls 44, 45, 46, and 47) into eight 24" by 24" multiple zones 90 through 97. Preferably each partition 80 through 86 is constructed from rigid fiberboard. In each zone 90 through 97, a sheet of transmission loss material 110, preferably a thick gypsum sheet, rests against and covers interior surface 58 of back wall 43. Transmission loss material 110 may be fixed into position using connection techniques such as glue. Transmission loss material 110 assists in reducing sound from passing into anechioic chamber 20 from the exterior 23. A wedge-base supporting member 111 retains the multiple fiberglass layers 74 of wedge base 72 in an elevated position from transmission loss material 110 to create air space 112. In the illustrative embodiment, an acoustically transparent shelf 114 with supporting legs 116 and 118, each preferably constructed of 22-gauge perforated steel to permit sound transmission, form the wedge-base supporting member 111. The region bounded by the acoustically transparent shelf 114 and transmission loss material 110 forms air space 112, which is critical to the sound-absorption function of anechoic wedge 70. Though wedge-base supporting member 111 of the illustrative embodiment is disclosed as an acoustically transparent shelf 114, alternate mounting and support methods may be employed.

Figure 6:
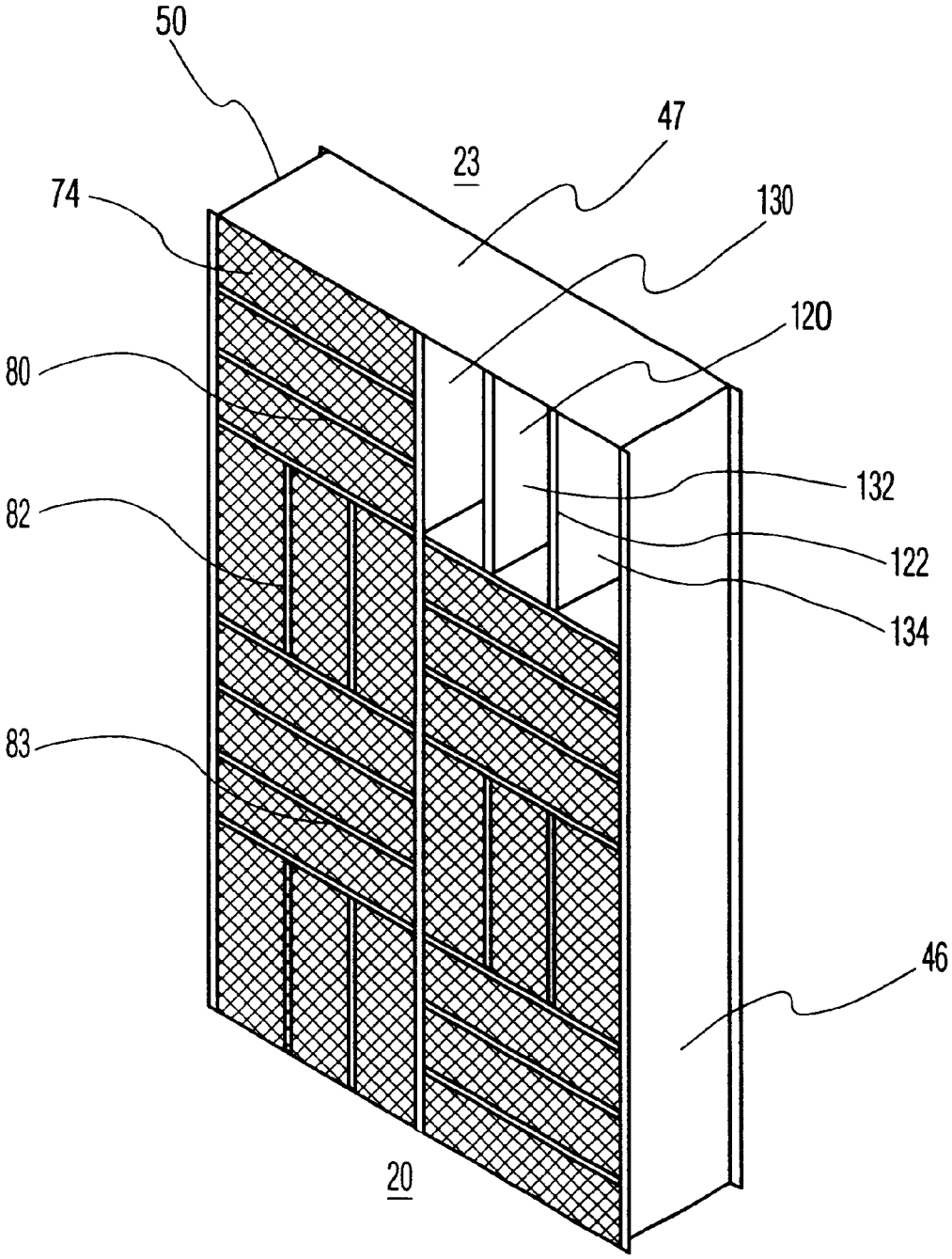
Figure 7:
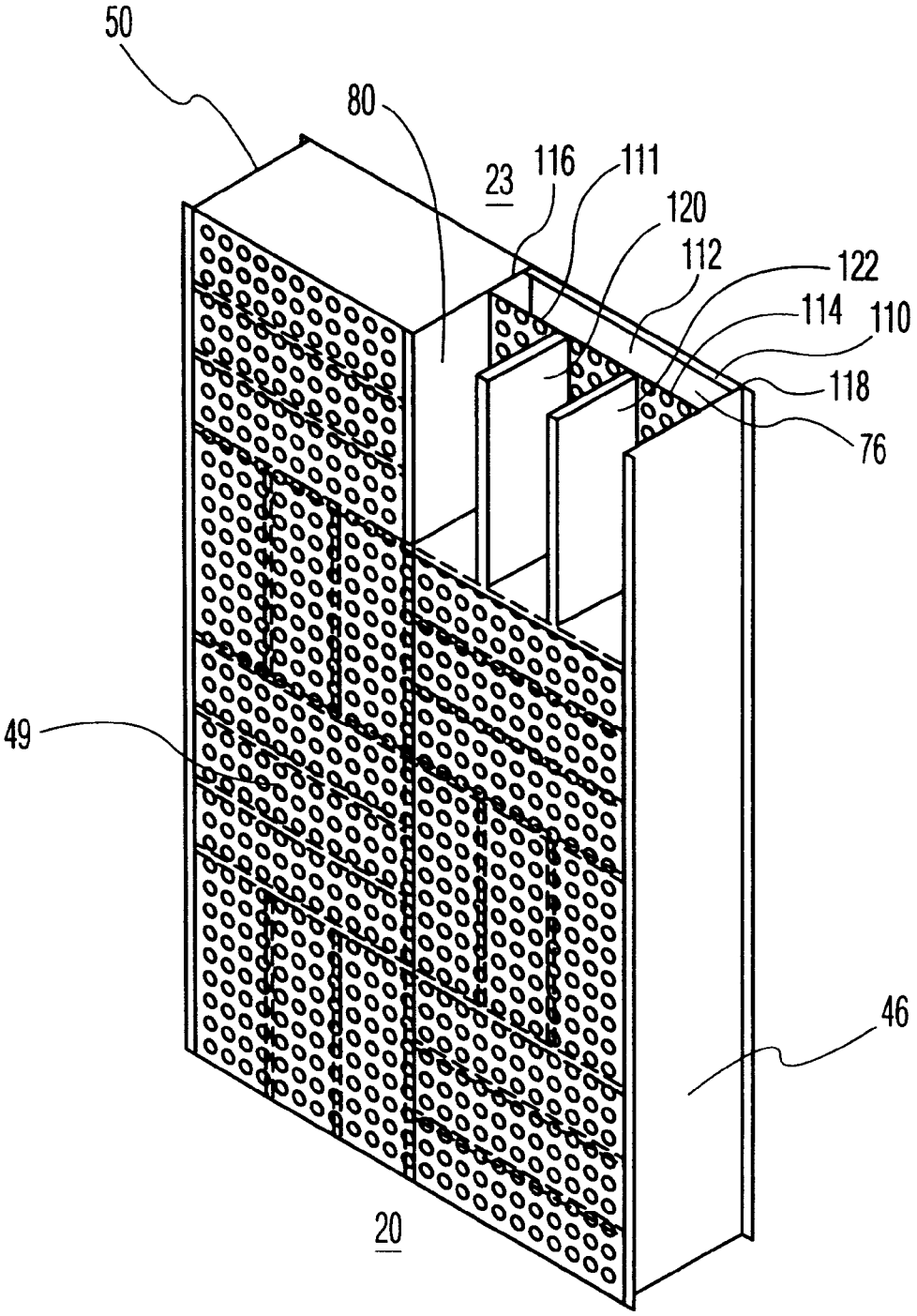
Figure 8:
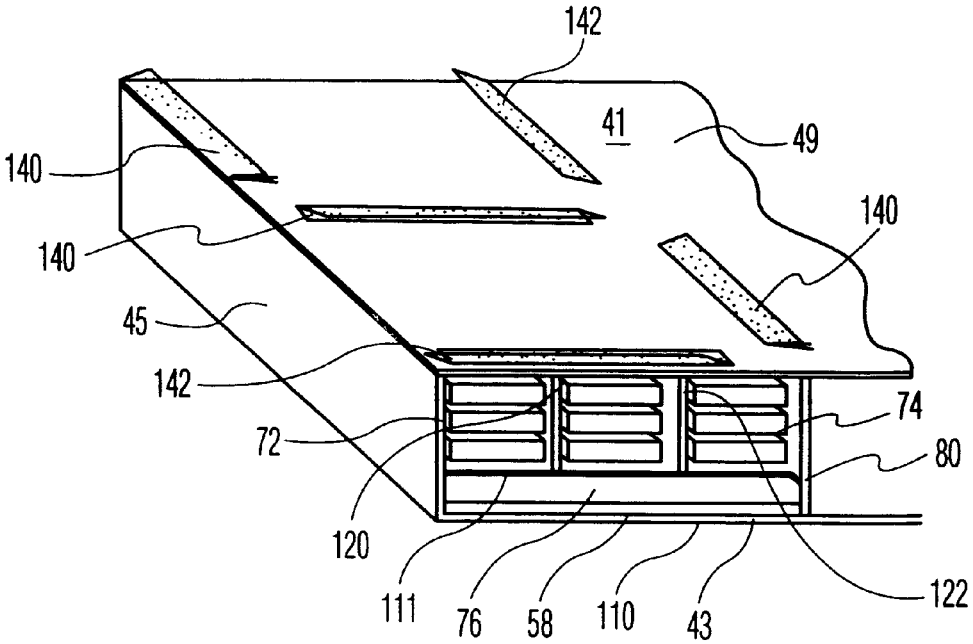
FIG. 8 is an isometric cut-away view showing the internal elements of an illustrative embodiment of a modular anechoic panel with the wedge tip compression clip system mounted upon tile face plate.

As shown in FIGS. 6, 7 and 8 detailing the internal structure of modular anechoic panel 20, cross members 120 and 122 preferably constructed of 1A, rigid fiberglass rest vertically on acoustically transparent shelf 114 and further partition each zone 90 through 97 into rectangular cells 130, 132,134. The multiple fiberglass layers 74 of the wedge base 72 are then layered in each cell 130, 132, 134. The multiple fiberglass layers 74 are preferably type-703 fiberglass, however, other suitable acoustic dampening materials well known in the art may be employed.

As shown in FIGS. 7 and 8, upon assembly of the interior components of the modular anechoic panel 40, face plate 49 may be fastened into place by means such as pop-riveting to lock the interior components into position. Final assembly includes mounting of a series of wedge tip compression clips 140 and 142 to face plate 49, which may be accomplished by conventional mounting means such as pop rivets.

Figure 9:
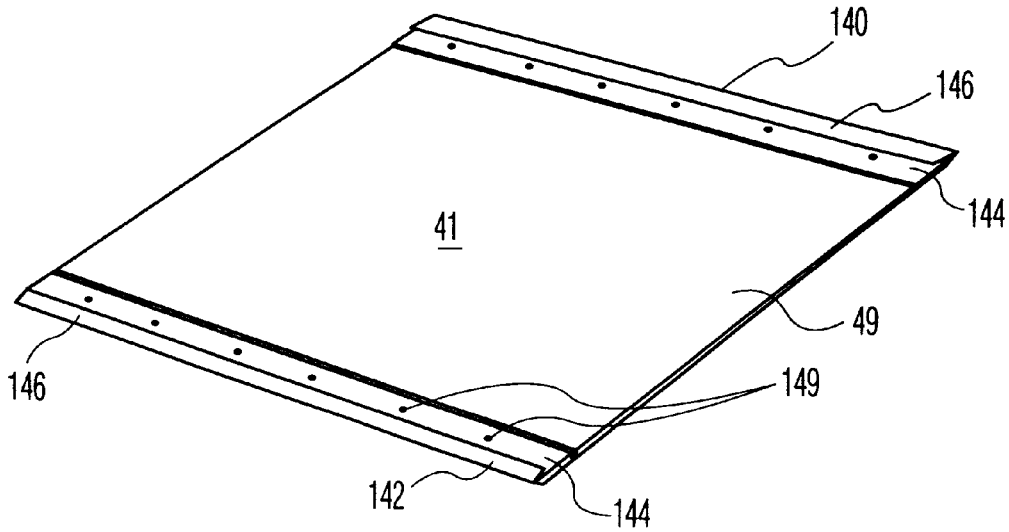
FIG. 9 is an isometric view illustrating the wedge tip compression clip system disposed upon the surface of the face plate.

FIG. 9 illustrates an illustrative embodiment of the wedge tip compression clip system in further detail. The wedge tip compression clip system includes alternating pairs of compression clips 140 and 142 each having a base 144 and an angle bracket 146. Compression clips 140 and 142 are preferably constructed of an acoustically transparent material, such as perforated steel, to minimize any chance of sound reflections. In the illustrative embodiment, clip base 144 of each compression clip 140 and 142 mount to face plate 49 by means of pop-rivets 149.

Figure 10:
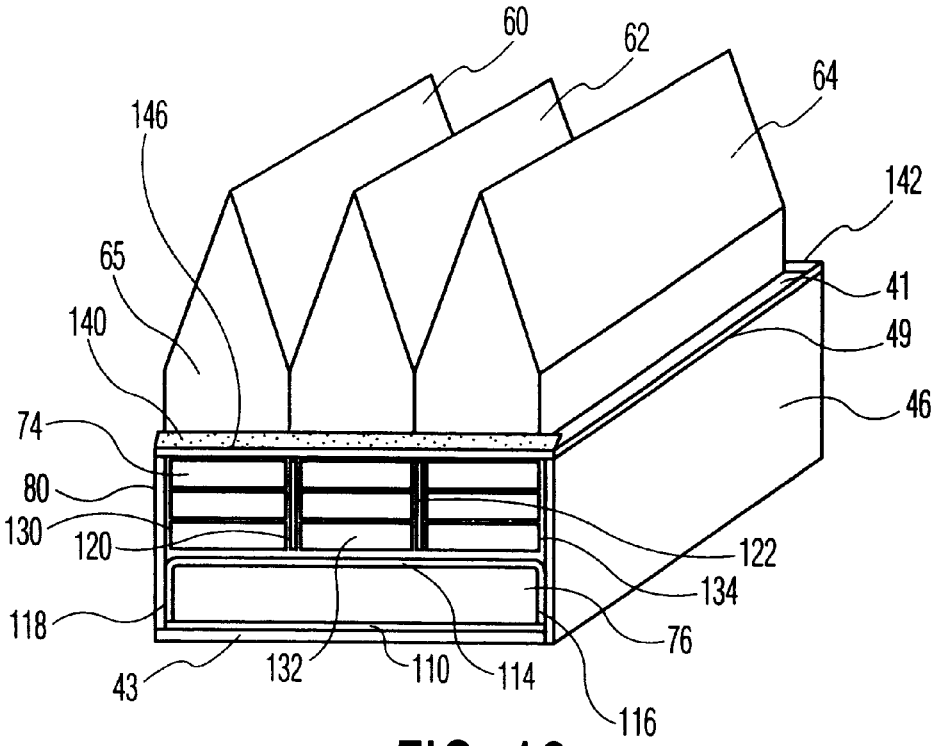
FIGS. 10 and 11 are isometric and side cut-away views illustrating a three cell zone of a modular anechoic panel and showing the mounting of a set of wedge tips.
Figure 11:
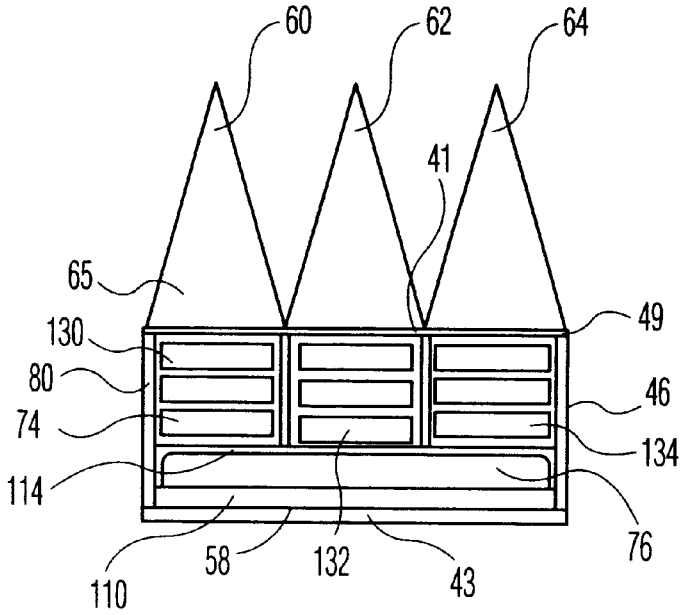

As illustrated in FIGS. 10 and 11, wedge tips 60, 62, and 64 easily mount against the exterior surface 41 of the face plate 49 using compression clips 140 and 142. Compression clips 140 and 142 are positioned to align wedge tips 60, 62 and 64 with cells 130, 132 and 134. In the illustrative embodiment, wedge tips 60, 62 and 64 preferably consist of a melamine material, which has a spongy elastomeric quality. Accordingly, wedge bottom 65 may be compressed to allow wedge tip 60 to be aligned and inserted between compression clips 140 and 142. Upon release of wedge tip bottom 65, angle brackets 146 will impinge upon wedge tip bottom 65 to hold wedge tip 60 in position. Each pair of compression clips 140 and 142 maintains three wedge tips 60, 62 and 64 flush to the face plate 49 and in alignment with the underlying fiberglass layers 74 of acoustical dampening material 76 in each cell 130,132, and 134. With relative ease, a person may selectively insert and remove wedge tips 60, 62 and 64 by compressing the bottom 65 of the selected wedge tip and either inserting it into or removing it into or removing it from a position between angle brackets 146 of compression clips 140 and 142.

As revealed in FIGS. 2, 7, 8 and 10, the configuration of each cell 130, 132, 134 and wedge tip 60, 62 and 64 of the fully assembled modular anechoic panel 40 constitutes an acoustic anechoic wedge 70.

Figure 12:
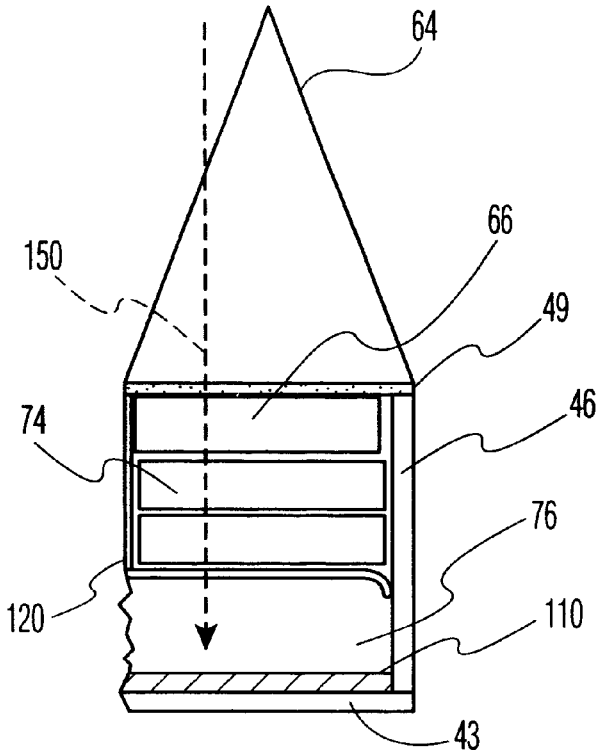
FIGS. 12 and 13 are side and longitudinal cut-away views showing the path of dissipated sound energy and the elements that make up a single cell of anechoic wedge in the illustrative embodiment of the modular anechoic panel.
Figure 13:
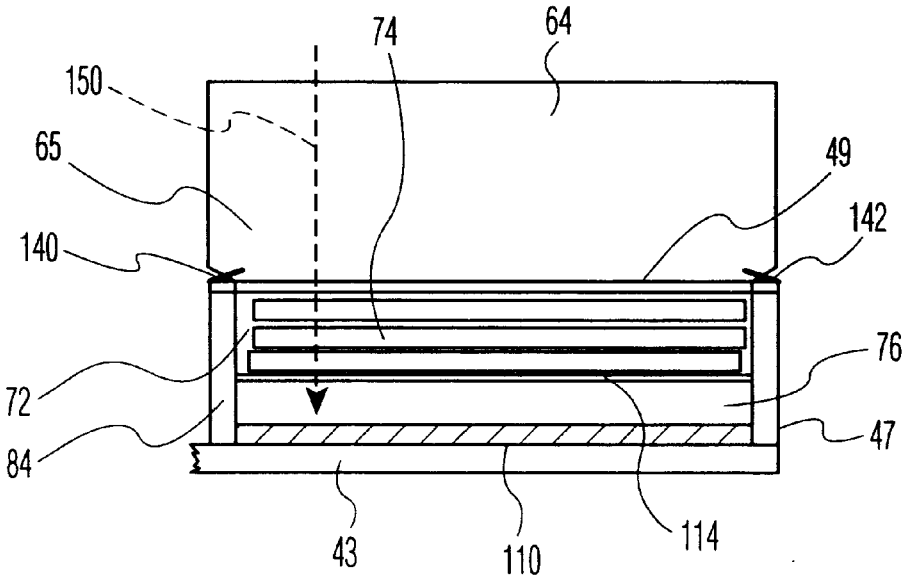
Figure 14A:
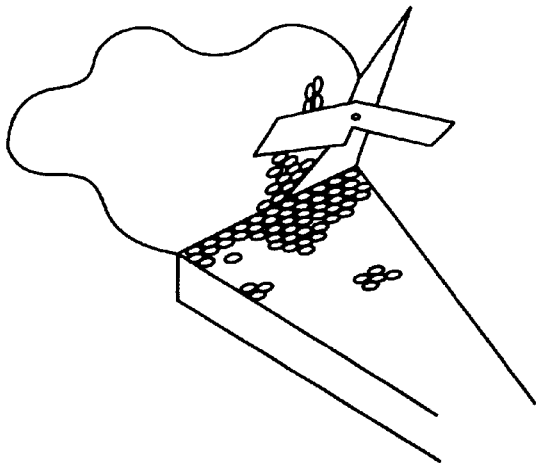
FIGS. 14 A–G show, respectively, a series of perspective transformative steps of a planar sheet of perforated metal into a wedge-shaped shell.
Figure 14B:
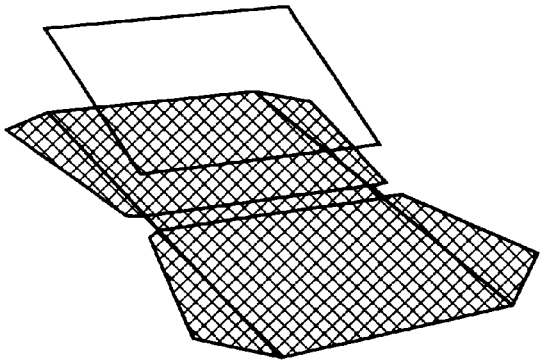
Figure 14C:
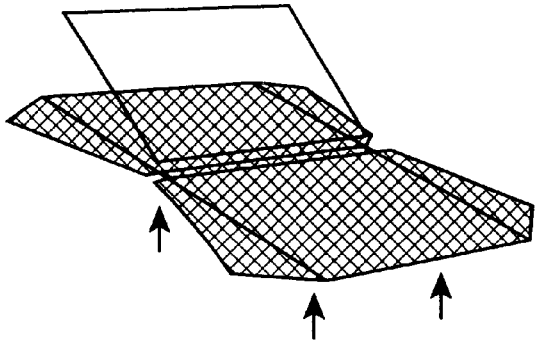
Figure 14D:
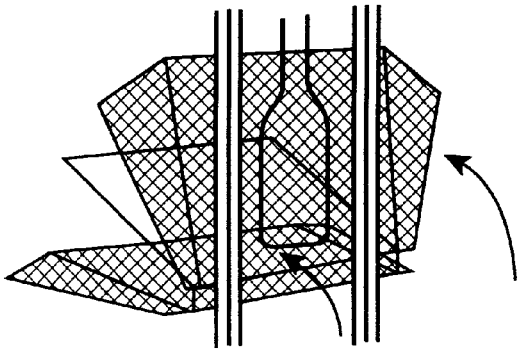
Figure 14E:
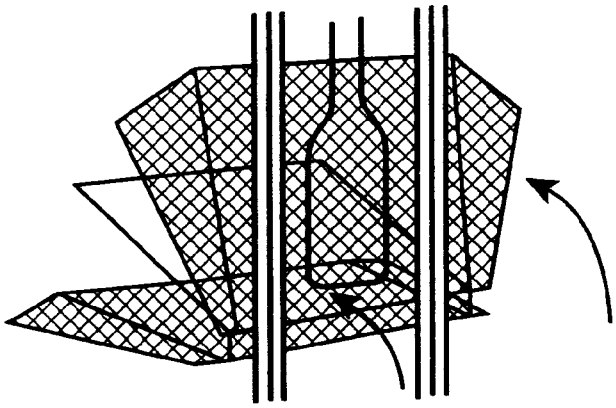
Figure 14F:
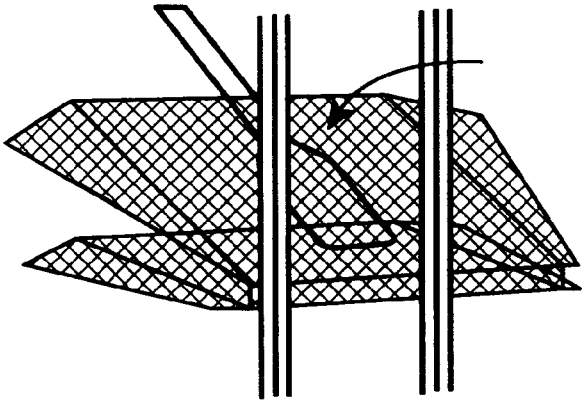
Figure 14G:
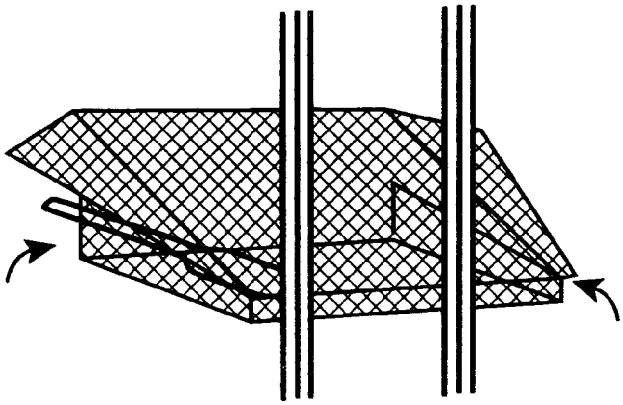

FIGS. 12 and 13 illustrate a single cell constituting the elements of an anechoic wedge 70. In operation, sound emissions 30 from specimen 32 travel along path 150, impacting wedge tip 64 and causing it to vibrate. The vibration energy continues to travel generally along path 150 through the sound-absorptive wedge tip 64, thereby dissipating a portion of the energy. The energy continues through face plate 49 and into the interior of the modular anechoic panel 40. As the energy from sound emissions 30 pass through the higher density multiple fiberglass layers 74 of wedge base 72, the energy is further dissipated.

Finally, any remaining energy substantially dissipates in air space 76 before impacting the transmission loss material 110. In similar fashion, transmission loss material 110 and airspace 76 sufficiently dampen any noise that attempts to enter the anechoic chamber 20 from the exterior 23 through the back wall 43.

In the illustrative embodiment, each modular anechoic panel 20 constitutes a single 4'×8'×1' structural member of a wall, ceiling or floor of an anechoic chamber 20. Accordingly, the modular anechoic panel system allows anechoic chamber 20 to be selectively assembled or disassembled. Accordingly, anechoic chamber 20 need not be a permanent fixture and may selectively be broken down for easy storage.

According to one embodiment, a modular anechoic panel system (MAPS) hemi-anechoic chamber is provided having an interior noise level of less than about 22 dB. cutoff frequency of 150 Hz (ANSI S12.35. ISO 3745, or ISO 7779), having external dimensions of 24 ft. length, 24 ft. width, and 14 ft. height, with nominal internal working dimensions of 22 ft. 4 in. width, 22 ft. 4 in. length, and 12 ft. 4 in. height. The preferred design comprises:

1. Acoustical Panel System having a relatively thick panel for high transmission loss and good absorption characteristics, a modular design for ease of installation and future modifications, and flexibility of chamber sizing and performance ratings:
2. Anechoic Wedge System, having a sheet metal cover sheet having a void ratio of above about 52% and preferably 63%, having high acoustic absorption characteristics, versatile design allowing a broad range of performance criteria to be met, while providing an interior which is free or exposed fiber:
3. Access Door System, having high performance doors to match wall acoustic performance, and allowing a wide range of door sizes and configurations;
4. Ventilation System designed with high performance supply and exhaust silencers, which may be a self-contained system or connected to a passive host connected heating/ventilation air conditioning (HVAC) systems, and optionally including specialty filtration, fume extraction, or other types of equipment:
5. Electrical System, having multiple receptacles for access to power, e.g., 120VAC and 240VAC line power, inside the chamber, which meets various local electrical codes, e.g., NEC, BOCA, etc.; and
6. Lighting System, having ceiling mound, heavy duty, high output incandescent fixtures, with corner mounted secondary lighting fixtures including dimmer controlled incandescent lamps, and specialty lighting, such as "Test in Progress" and "Emergency Exit".

The preferred anechoic chamber panel-wedge assemblies preferably comply with ASTM specification E-1050-90, having a normal incidence absorption coefficient of not less than 0.99 at 150 Hz.

The MAPS panels are preferably constructed of 16 gauge galvanized-bonderized, cold rolled steel outer surface and 22 gauge galvanized-bonderized, cold rolled steel inner surface. The sheets are perforated with 3/32" holes on 3/16" staggered centers providing a 23% open area. These panels are filled with five inches of acoustical glass fiber insulation, with a two inch air space and one inch of gypsum wallboard. Internal framing members are formed of 16 gauge galvanized-bonderized, cold rolled steel, spaced 24 inches apart. All welds ae spaced at 4–6" intervals and ground smooth.

Wedge tips are 8" wide by 24" long by 12" deep (150 Hz cutoff frequency), which are fastened to the inner wall surface in alternating 90 degree rotated groups of three, using compression clips affixed to the chamber walls. The wedge is constructed of sheet metal, 22 gauge galvanized-bonderized, cold rolled steel perforated with 5/32 staggered, 0.156" diameter holes on 3/16 centers (accurate Perforating Company), having a 63% void area. The wedge is completely filled with absorptive material.

Figure 17C:
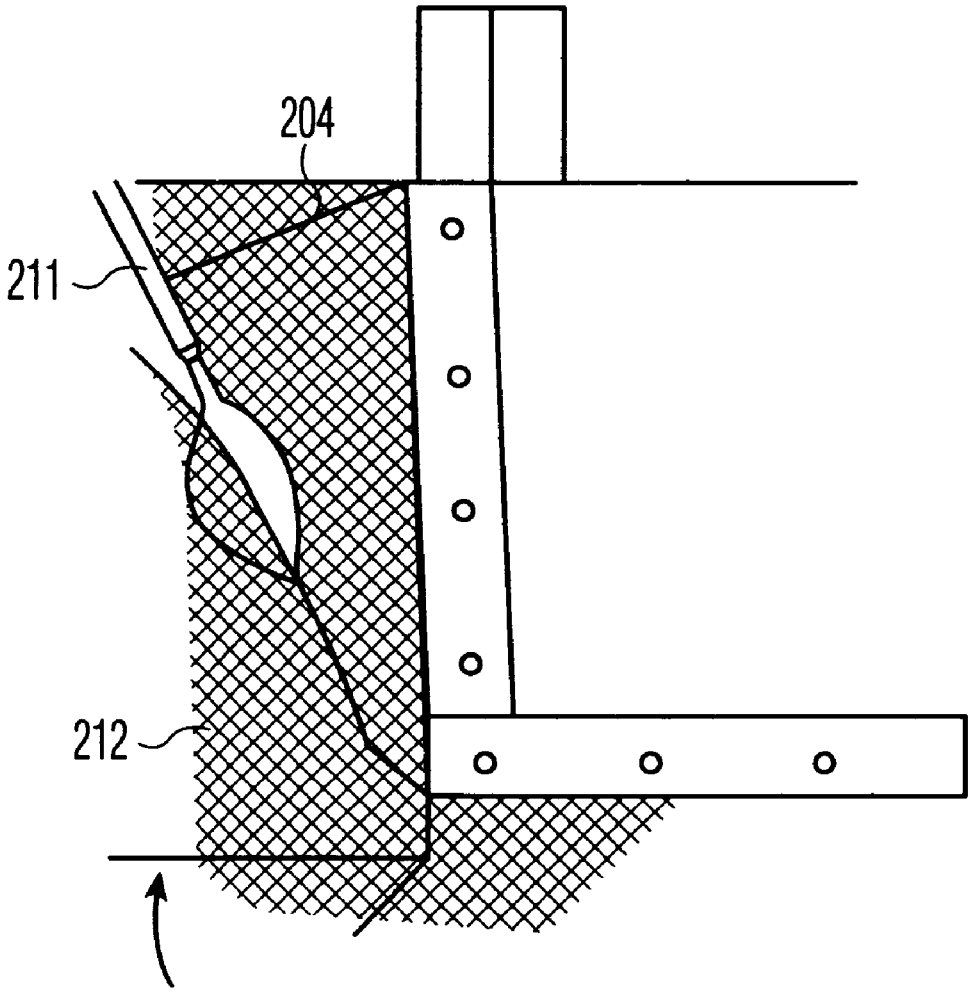
Figure 17F:
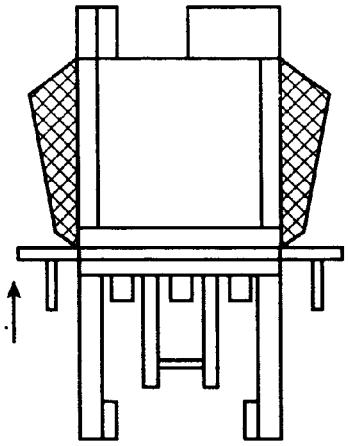
Figure 17F:
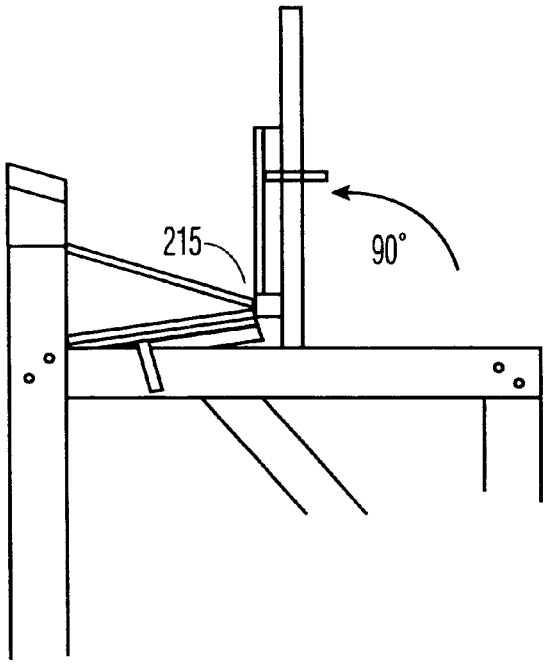
Figure 17F:
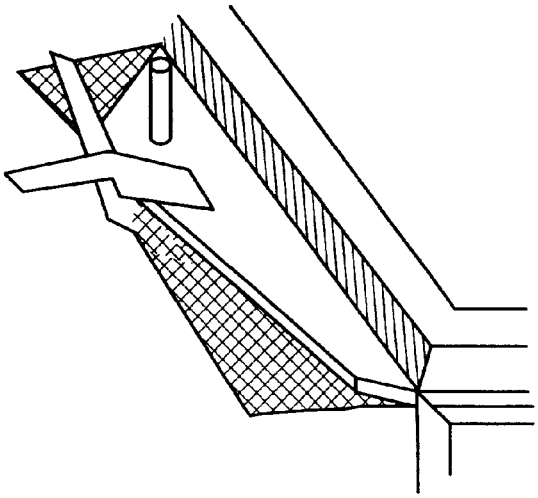
Figure 17H:
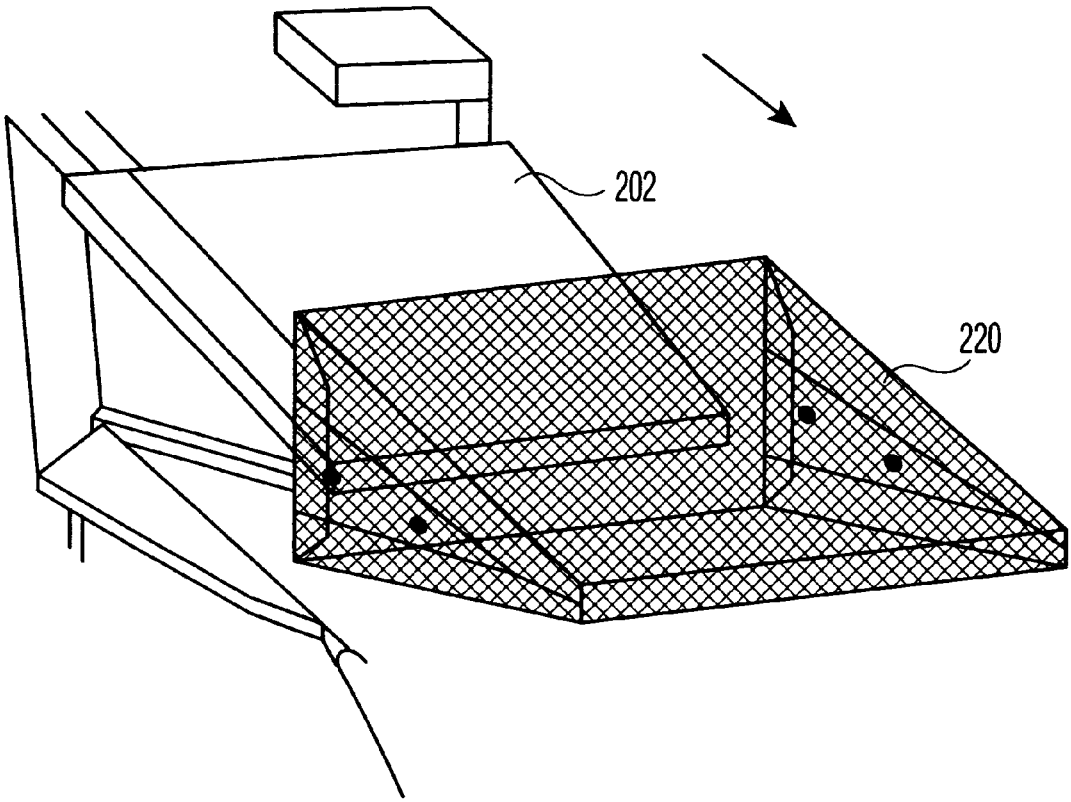
Figure 18A:
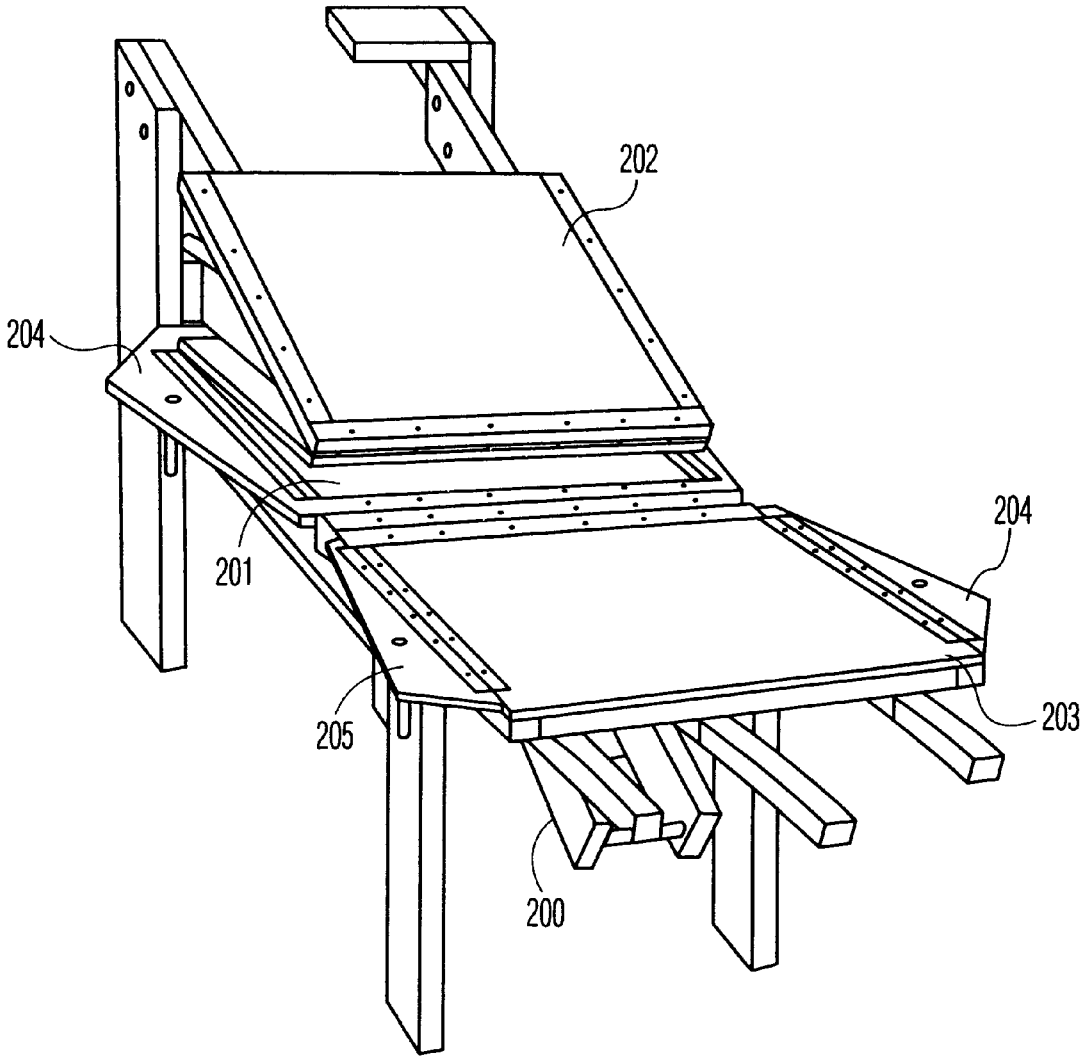
FIGS. 18A–18E show a front perspective view, and side view hinge details of a bending apparatus.
Figure 18B:
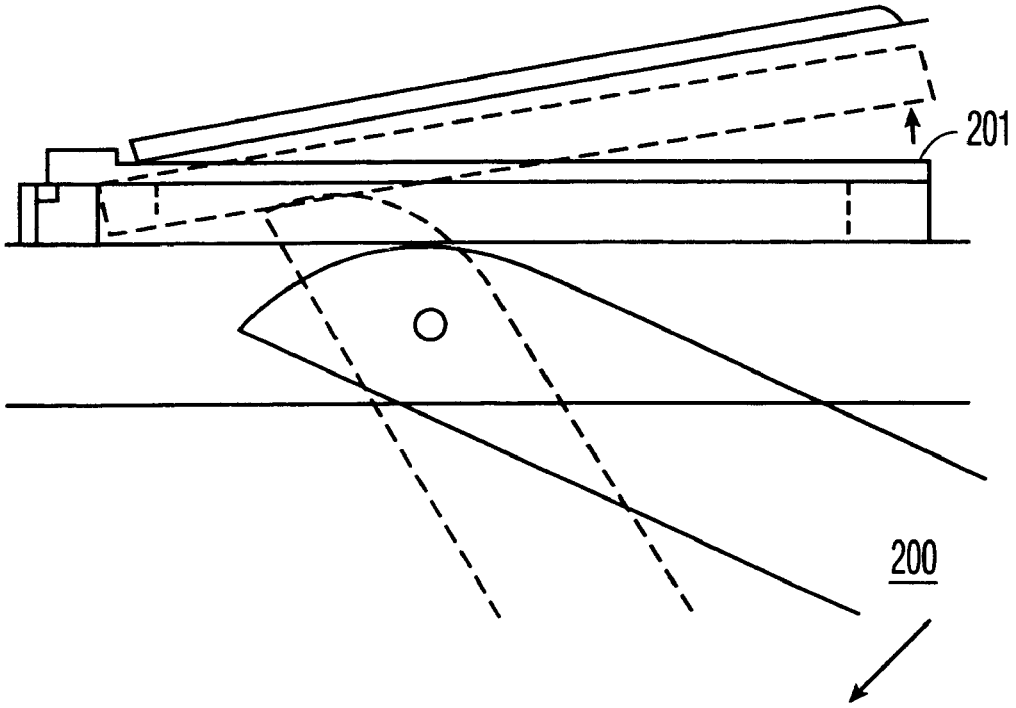
Figure 18C:
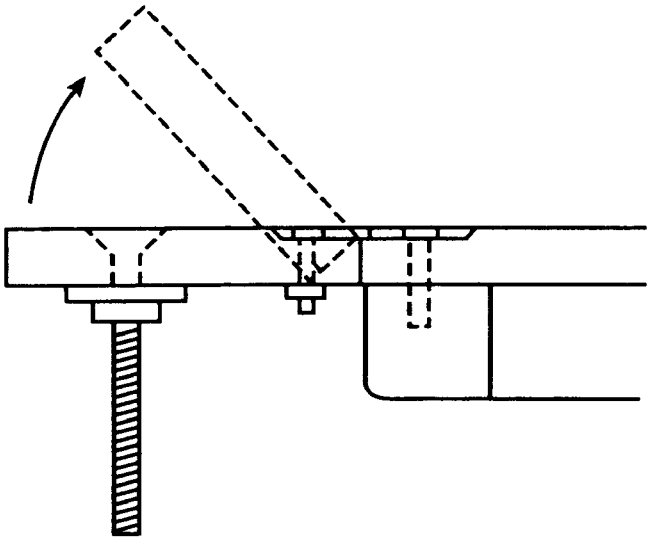
Figure 18D:
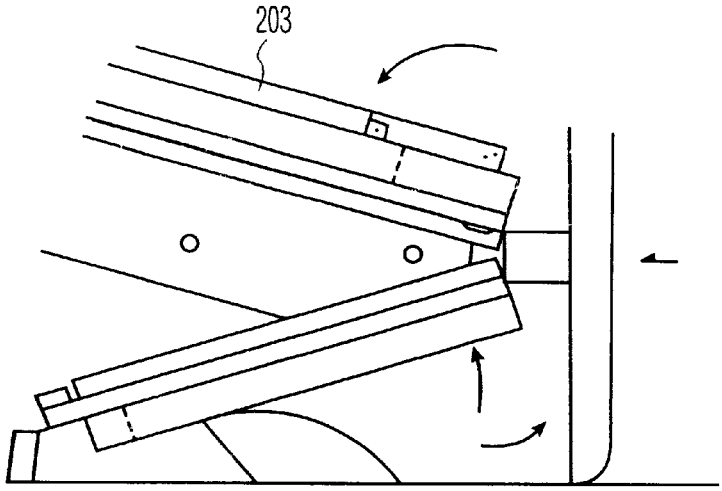
Figure 18E:
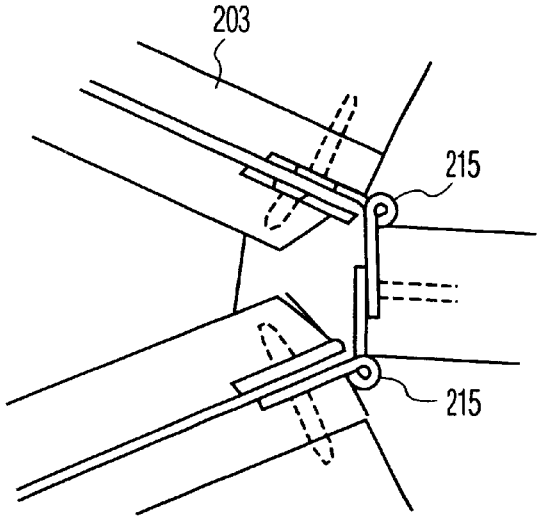
Figure 18F:
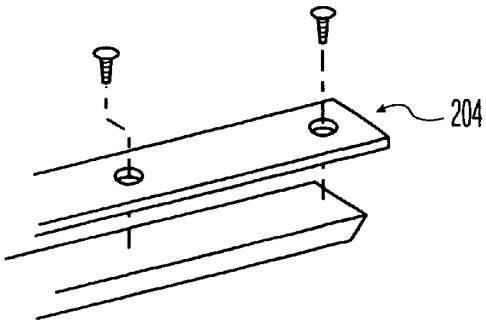

The wedge tips are fabricated by first precut into a rectangular sheet 210 of perforated metal sheet of appropriate size (FIG. 17A1), and placed onto a table 201 of a compound break, partially under a wedge form 202 (FIG. 17A2). The table 201 is then raised by pressing a pedal 200 (FIGS. 17B1 and 17B2), so that the perforated sheet 210 is between the table 201 and wedge form 202. Metal shears 211 are then used to trim the edges 212 of the rear 213 (portion below the wedge form) to size. With rear template flaps 204 as guides (FIG. 17C). The perforated sheet 210 is then folded in an acute angle, by flexing a joint 215 in the table 201 (FIGS. 17D1 and 17D2), and metal shears 211 are used to trim the edges 216 of the front portion 214 to size (FIG. 17F), now sandwiched between the table 201, table extension 203, and wedge form 202, using the template flaps 205 for guidance (FIG. 17E1). The front and rear flaps 217 are then folded toward each other (FIGS. 17G1 and 17G2), and connected together with 1/8" pop rivets 218 (FIG. 17G3), and 1/10" skirt rivets, which fit through respective perforations without drilling. The table 201, 203 is then opened, allowing the formed perforated sheet metal wedge shell 220 to be removed from the wedge form 202 (FIG. 18H).

These same operations are shown in FIGS. 14A–14G, separate from the forming apparatus.

Figure 15A:
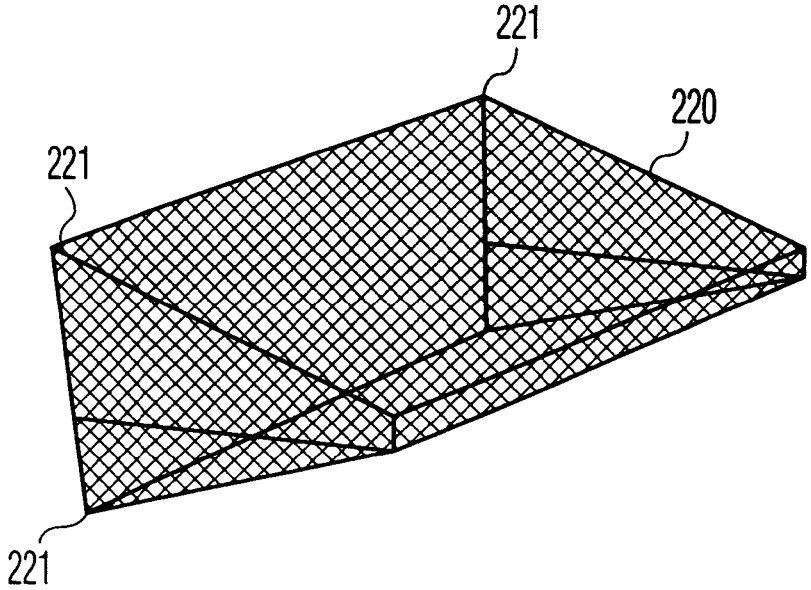
FIGS. 15A and 15B shows, respectively, a perspective view of a wedge shell having notched corners and a detail of a corner notch.
Figure 15B:
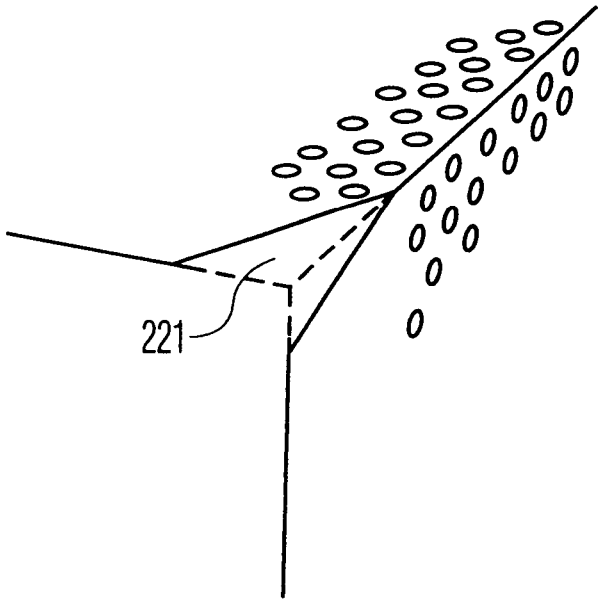
Figure 15C:
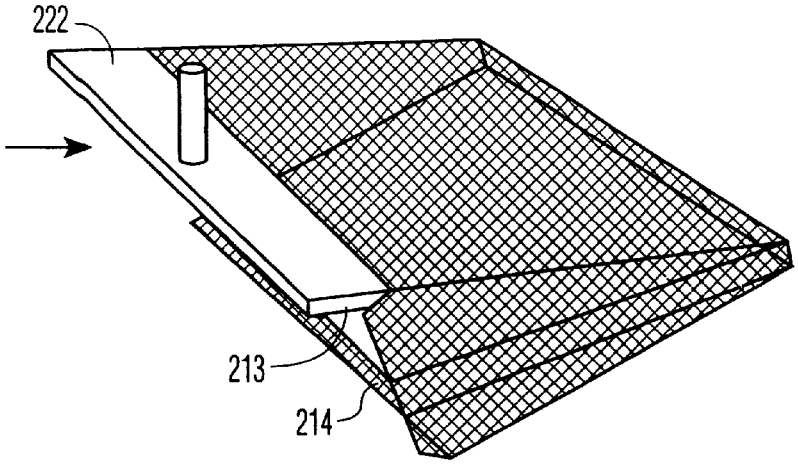
Figure 15D:
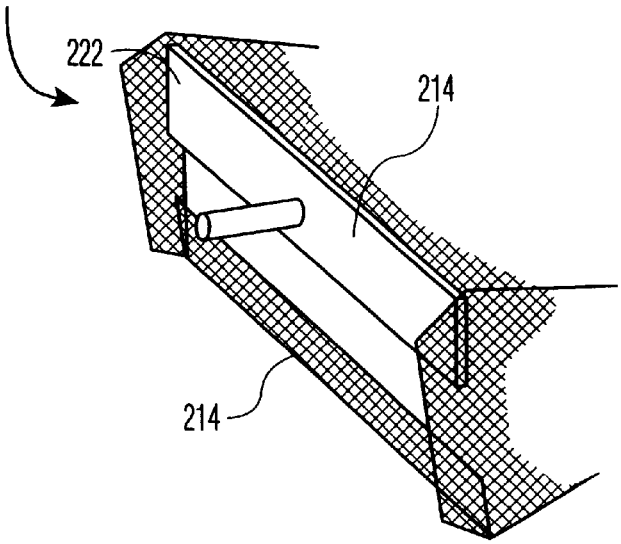
Figure 15E:
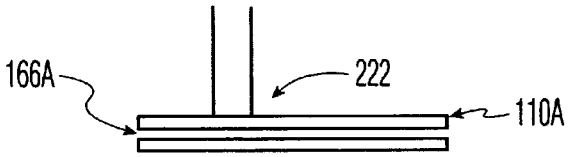
FIG. 15E shows an end view of a bending tool.
Figure 15F:
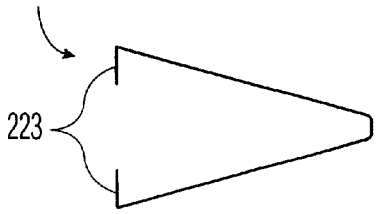
FIG. 15F shows a cross section view of FIG. 15D.
Figure 16A:
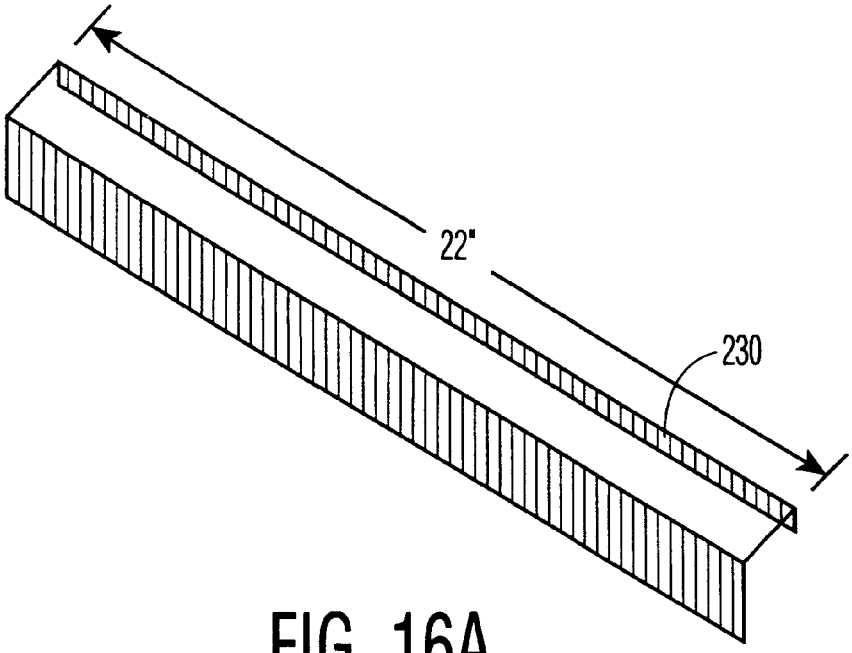
FIGS. 16A and 16B show, respectively, a perspective and side view of a wedge clip.
Figure 16B:
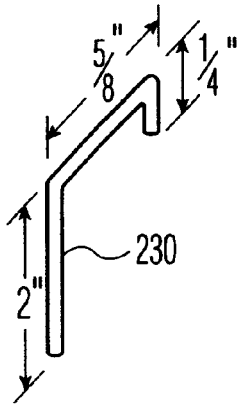
Figure 16C:
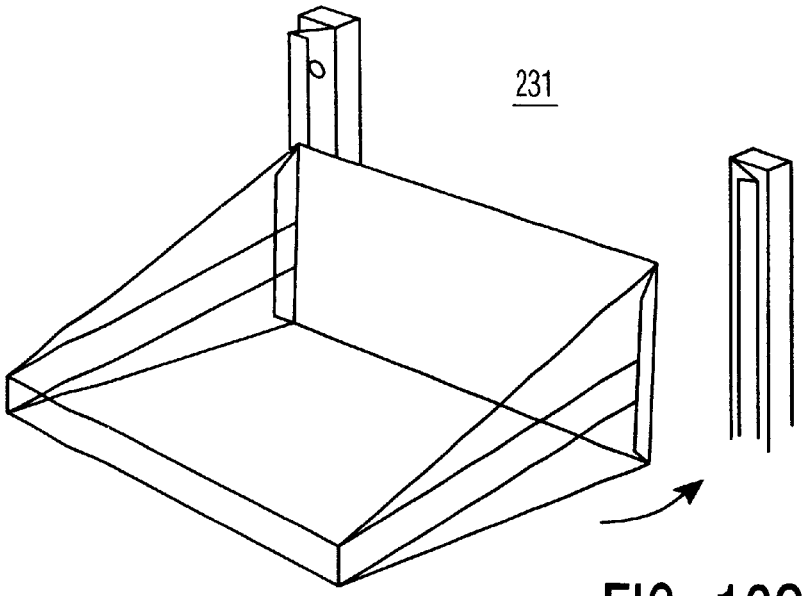
FIGS. 16C and 16E show an installation of a wedge in a pair of wedge clips.
Figure 16D:
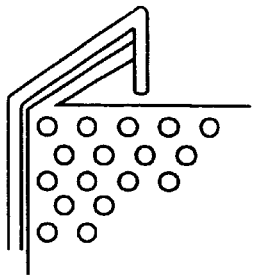
FIG. 16D shows a detail side view of a wedge lip retained by a wedge clip.
Figure 16E:
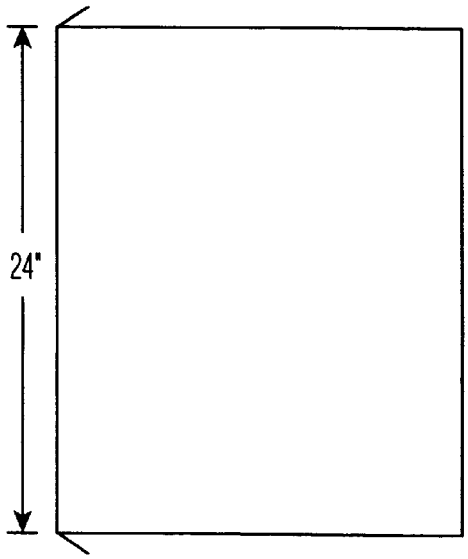

In order to mount the wedge, the corners 221 are first notched, about 1" from the edge, to form a bevel (FIGS. 15A and 15B). Using a sheet bending tool 222, the front and back flaps 213, 214 are placed between portions of the bending tool 222, and inwardly bent at the notched bevel, to form a flat partial surface 223 (FIGS. 15C and 15D). The side flaps 224 are trimmed to about ½", and bent outwardly at about a 135 degree angle, to form wings 225 (FIGS. 15G, 15H, 15I and 15J). A wedge clip 230, formed of 22 gauge, small hole perforated sheet, is formed as a bracket 22" long (FIGS. 16A and 16B), and is mounted on the wall 231 (the MAPS panel) 24" apart (FIG. 16C). The spaced wedge clips 230 snap in and lock the side wings 225 of each wedge 220 in place, the pair of brackets 230 holding three wedges 220 in a row (FIGS. 16D and 16E). The acoustically absorptive filling, for example, acoustical glass fiber insulation, is stuffed in the wedge 220 shell prior to mounting, but after fabrication.

Figure 19A:
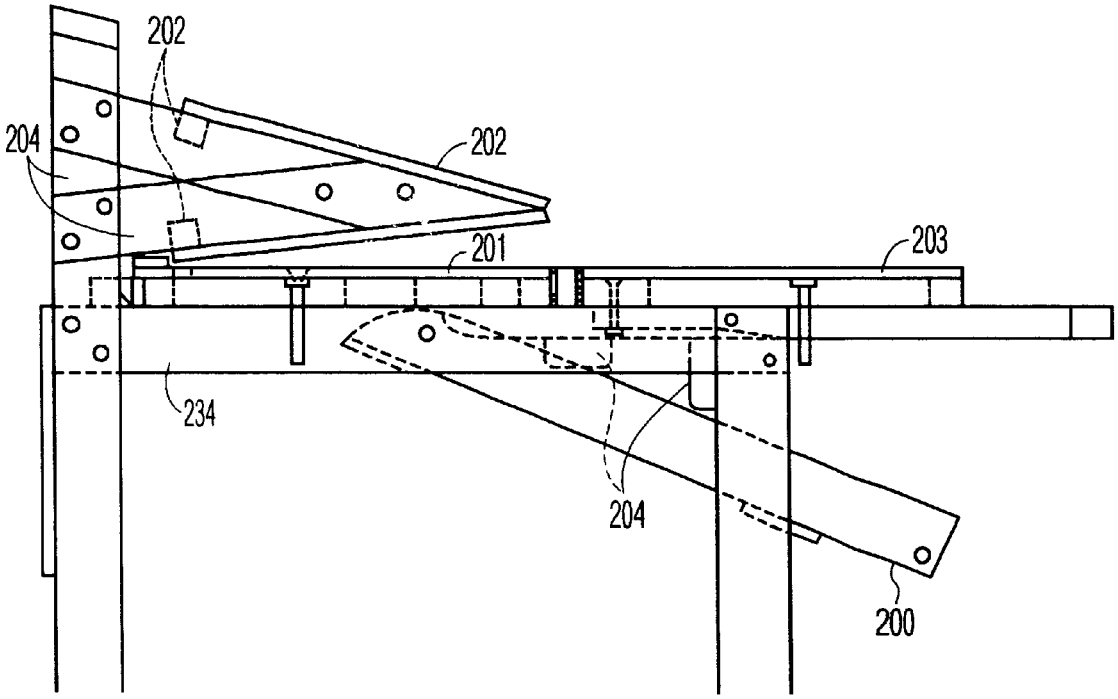
FIGS. 19A and 19B show, respectively, a side view and perspective hinge detail, respectively, of the apparatus according to FIGS. 18A–18E.
Figure 19B:
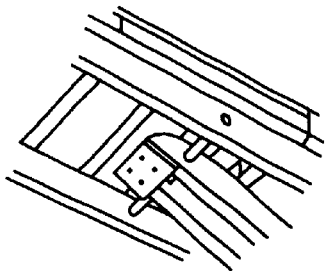

The compound break form shown in FIGS. 18 and 19, includes a foot-operated lift pedal 200, for lifting the table 201 upward toward the wedge form 202, as well as a hinged table extension 203, which folds over the top of the wedge form 202. The table 201 and table extension 203 each have hinged template portions 204. 205, which serve the dual purpose of providing a template for cutting the perforated sheet to size, and for folding the sides of the sheet inward.

Although an illustrative embodiment and its advantages have been described in detail above, they have been described as example and not as limitation. Various changes, substitutions and alterations can be made in the illustrative embodiment without departing from the breadth, scope, and spirit of the claims.

What is claimed is:

1. A modular wedge for an anechoic panel, comprising a unitary perforated metal sheet having greater than about 63% void area, formed in a wedge shape having a depth, and having therein an acoustically absorptive material, having an acoustic absorption of at least 90% at a cutoff frequency defined by a corresponding wavelength 4 times the depth.

2. The modular wedge according to claim 1, wherein the sheet has a void area of about 63%.

3. The modular wedge according to claim 1, wherein the sheet is 22 gauge steel.

4. The modular wedge according to claim 1, wherein the sheet is 22 gauge, cold rolled steel perforated with 5/32 staggered, 0.156" diameter holes on 3/16" centers, having a 63% void area.

5. The modular wedge according to claim 1, wherein the is sheet held in conformation by a set of rivets, said rivets passing each through at least two regular perforations in said perforated metal sheet.

6. The modular wedge according to claim 1, wherein the wedge is 8" wide by 24" long by 12" deep.

7. The modular wedge according to claim 1, wherein the wedge has a characteristic 150 Hz cutoff frequency.

8. The modular wedge according to claim 1 wherein said acoustically absorptive material comprises a plurality of layers.

9. The modular wedge according to claim 1 wherein said wedge comprises integral means, formed from said sheet, for attachment to a bracket.

10. The modular wedge according to claim 1 wherein said wedge comprises a pair of opposed wings, formed from said sheet, for attachment to a pair of brackets.

11. A method for forming an anechoic wedge, comprising the steps of:

providing a sheet of regularly perforated metal having a void area of greater than about 63%;

folding the sheet in half at an acute angle;

inwardly folding lateral edges of each folded half; and riveting, through perforations in the perforated sheet at overlapping portions of the inwardly folded lateral edges, to retain the perforated sheet folded at the acute angle.

12. The method according to claim 11, wherein the sheet has perforations greater than 0.10" in diameter.

13. The method according to claim 11, further comprising the step of trimming the lateral edges of each folded half prior to inwardly folding thereof.

14. The method according to claim 11, further comprising the step of providing a set of lateral edge templates, wherein said templates guide a trimming operation of the lateral edges and provide a hinged member for controlling an inward bending of the lateral edges.

15. The method according to claim 11, further comprising the step of placing the perforated metal sheet on a table having a hinge, and below a forming member, prior to folding, said folding step folding the sheet about the hinge to form the sheet between the folded table and forming member.

16. The method according to claim 11, further comprising the step of beveling the corners of the riveted sheet, and inwardly bending at least one portion of the riveted sheet.

17. The method according to claim 11, further comprising the step of beveling the corners of the riveted sheet, and outwardly bending at least one portion of the riveted sheet.

18. The method according to claim 11, further comprising the step of beveling the corners of the riveted sheet, and inwardly bending one pair of opposed sides and outwardly bending the other pair of opposed sides.

19. A substantially enclosed sound absorbing unit for an anechoic chamber, comprising:

a substantially flat panel member having a layer of sound absorptive material;

an anechoic wedge member disposed adjacent to said flat panel member, said anechoic wedge member configured having a base and four protruding walls, at least two of which are convergent, formed from a substantially sound transparent sheet having perforations formed therein, said perforations encompassing at least about 63% of the total area of the sheet.

20. The sound absorbing unit according to claim 19 wherein said anechoic wedge member is space from said panel member.

21. The sound absorbing unit according to claim 19, wherein said perforations encompass about 63% of the total area of the sheet.

22. The sound absorbing unit according to claim 19, wherein said perforations form a free area in the range of approximately 63% to 80% of the entire area of the sheet.

23. The sound absorbing unit according to claim 19 wherein said anechoic wedge member is filled with an acoustically absorptive composition.

24. The sound absorbing unit according to claim 19 wherein said anechoic wedge member is filled with acoustically absorptive fiberglass.

25. A modular wedge for an anechoic panel, comprising a unitary perforated metal sheet having greater than about 52% void area, formed in a wedge shape having a depth, and having therein an acoustically absorptive material, having an acoustic absorption of at least 90% at 150 Hz.

26. The modular wedge according to claim 25, wherein the sheet has a void area of about 63%.

27. The modular wedge according to claim 25, wherein the wedge is 8" wide by 24" long by 12" deep.

28. The modular wedge according to claim 25, wherein said wedge comprises integral means, formed from said sheet, for attachment to a bracket.

29. The modular wedge according to claim 25, wherein said wedge comprises a pair of opposed wings, formed from said sheet, for attachment to a pair of brackets.

30. The modular wedge according to claim 25, wherein said perforations form a free area in the range of approximately 52% to 80%.

31. A substantially enclosed sound absorbing unit for an anechoic chamber, comprising:

a substantially flat panel member having a layer of sound absorptive material;

an anechoic wedge member disposed adjacent to said flat panel member, said anechoic wedge member configured having a base and four protruding walls, at least two of which are convergent, formed from a substantially sound transparent sheet having perforations formed therein, said perforations encompassing at least about 52% of the total area of the sheet, said anechoic wedge member having an acoustic absorption of at least 90% at 150 Hz.

32. The unit according to claim 31, wherein the sheet has a void area of about 63%.

33. The unit according to claim 25, wherein said anechoic wedge has a base which is 8" wide by 12" deep, said at least two convergent walls extending 24" from the base.

* * * * *